US012037029B2

(12) United States Patent
Graham

(10) Patent No.: US 12,037,029 B2
(45) Date of Patent: Jul. 16, 2024

(54) RAILCAR SYSTEMS AND CARGO TRANSPORTATION METHODS

(71) Applicant: TSG CANADA HOLDINGS INC., Tilbury (CA)

(72) Inventor: Timothy Scott Graham, Tilbury (CA)

(73) Assignee: TSG CANADA HOLDINGS INC., Tilbury (CA)

( * ) Notice: Subject to any disclaimer, the term of this patent is extended or adjusted under 35 U.S.C. 154(b) by 0 days.

(21) Appl. No.: 17/679,277

(22) Filed: Feb. 24, 2022

(65) Prior Publication Data

US 2023/0227079 A1 Jul. 20, 2023

Related U.S. Application Data

(60) Provisional application No. 63/301,185, filed on Jan. 20, 2022.

(51) Int. Cl.
*B61D 47/00* (2006.01)
*B61D 3/02* (2006.01)
*B61D 39/00* (2006.01)

(52) U.S. Cl.
CPC ..... *B61D 47/00* (2013.01); *B61D 3/02* (2013.01); *B61D 39/001* (2013.01); *B61D 39/002* (2013.01)

(58) Field of Classification Search
CPC ..... B61D 47/00; B61D 3/02; B61D 39/001; B61D 39/002; B61D 3/20; B61D 3/16; B61D 39/00; B61D 3/00
See application file for complete search history.

(56) References Cited

U.S. PATENT DOCUMENTS

| | | | | |
|---|---|---|---|---|
| 2,053,969 | A | 10/1927 | Olds | |
| 1,833,569 | A | 8/1930 | Grady | |
| 2,588,732 | A | 3/1952 | Kemp, Jr. | |
| 2,632,578 | A | 3/1953 | Brickman | |
| 2,977,900 | A * | 4/1961 | Farrar | B61D 39/00 220/678 |
| 3,014,604 | A | 12/1961 | Loomis | |
| 3,096,730 | A | 7/1963 | Gutridge | |
| 3,126,105 | A | 3/1964 | Marguet | |
| 3,358,616 | A | 12/1967 | Brodhead | |
| 3,626,872 | A | 12/1971 | Cully | |

(Continued)

FOREIGN PATENT DOCUMENTS

| | | |
|---|---|---|
| AT | 1135 U1 | 11/1996 |
| CN | 2441704 Y | 8/2001 |

(Continued)

OTHER PUBLICATIONS

International Search Report and Written Opinion mailed Mar. 28, 2023 for corresponding Int'l Patent Application PCT/CA2023/050053.

(Continued)

*Primary Examiner* — Scott A Browne
(74) *Attorney, Agent, or Firm* — Dicke, Billig & Czaja, PLLC

(57) ABSTRACT

Cargo transport systems and cargo transport vessels that are used in combination with removable carriers that can be loaded and unloaded into the cargo transport vessel, and methods of using these systems, vessels, and removable carriers.

20 Claims, 28 Drawing Sheets

(56) References Cited

U.S. PATENT DOCUMENTS

| | | | | |
|---|---|---|---|---|
| 3,641,941 | A * | 2/1972 | Sanders | B61D 45/006 410/134 |
| 3,673,812 | A | 7/1972 | Pierce | |
| 3,823,674 | A | 7/1974 | Dupre | |
| 3,831,792 | A | 8/1974 | Waterman et al. | |
| 4,027,805 | A | 6/1977 | Beumer et al. | |
| 4,099,635 | A | 7/1978 | Leonard et al. | |
| 4,239,008 | A | 12/1980 | Conlon | |
| 4,268,201 | A | 5/1981 | Cayton | |
| 4,284,380 | A | 8/1981 | Brumbaugh, Jr. et al. | |
| 4,479,750 | A | 10/1984 | Johnson, Jr. | |
| 4,497,259 | A | 2/1985 | Titterton | |
| 4,640,657 | A | 2/1987 | Moore et al. | |
| 4,659,274 | A | 4/1987 | France | |
| 4,759,294 | A | 7/1988 | Schuller et al. | |
| 4,946,214 | A | 8/1990 | Neumann et al. | |
| 4,978,014 | A | 12/1990 | Humitz et al. | |
| 5,183,369 | A | 2/1993 | Warren, Jr. et al. | |
| 5,230,434 | A * | 7/1993 | Patrick | B60P 1/52 220/772 |
| 5,271,336 | A | 12/1993 | Willetts | |
| 5,402,732 | A | 4/1995 | Erickson et al. | |
| 5,460,465 | A | 10/1995 | Little | |
| 5,628,606 | A | 5/1997 | Herzog et al. | |
| 5,895,194 | A | 4/1999 | Galas et al. | |
| 6,155,767 | A | 12/2000 | Walker | |
| RE37,062 | E | 2/2001 | Walker | |
| 6,183,176 | B1 | 2/2001 | Weiner | |
| 6,190,107 | B1 | 2/2001 | Lanigan, Sr. et al. | |
| 6,261,045 | B1 | 7/2001 | McFall | |
| 6,283,700 | B1 | 9/2001 | Oltrogge | |
| 6,520,729 | B1 | 2/2003 | Gibson | |
| 6,561,742 | B1 | 5/2003 | Crawford et al. | |
| 6,835,041 | B1 | 12/2004 | Albert | |
| 6,983,704 | B1 * | 1/2006 | Ness | E21B 21/01 108/55.3 |
| 7,411,136 | B2 | 8/2008 | Walker | |
| 7,686,561 | B2 | 3/2010 | Smith et al. | |
| 7,854,577 | B2 | 12/2010 | Green | |
| 7,878,124 | B2 | 2/2011 | Low et al. | |
| 7,950,891 | B2 | 5/2011 | Weidemann et al. | |
| 8,256,355 | B2 | 9/2012 | Dial et al. | |
| 8,342,104 | B2 | 1/2013 | Ramser et al. | |
| 8,348,585 | B2 | 1/2013 | Salmoiraghi | |
| 8,371,236 | B2 | 2/2013 | Budnick | |
| 8,631,746 | B2 | 1/2014 | Knight et al. | |
| 9,162,603 | B2 | 10/2015 | Oren | |
| 9,409,507 | B2 | 8/2016 | Budd et al. | |
| 9,463,922 | B2 | 10/2016 | Steiner | |
| 9,908,723 | B2 | 3/2018 | Disorbo | |
| 10,221,022 | B2 | 3/2019 | Campbell et al. | |
| 10,221,023 | B2 | 3/2019 | Shook et al. | |
| 10,294,047 | B2 | 5/2019 | Hathaway et al. | |
| 10,597,241 | B2 | 3/2020 | Campbell et al. | |
| 10,676,108 | B2 | 6/2020 | Cencer et al. | |
| 10,789,567 | B1 * | 9/2020 | Ur | G08G 5/0069 |
| 11,040,828 | B1 * | 6/2021 | Ward | G01C 21/20 |
| 11,192,732 | B2 | 12/2021 | Campbell et al. | |
| 2006/0243159 | A1 | 11/2006 | Khattab et al. | |
| 2007/0089638 | A1 | 4/2007 | Taylor | |
| 2007/0194017 | A1 | 8/2007 | Markwell | |
| 2007/0264097 | A1 | 11/2007 | Fellon et al. | |
| 2007/0297882 | A1 | 12/2007 | Villar et al. | |
| 2008/0219804 | A1 * | 9/2008 | Chattey | B66C 19/002 414/140.3 |
| 2008/0317567 | A1 | 12/2008 | Rother et al. | |
| 2010/0114404 | A1 * | 5/2010 | Donnelly | B61D 15/00 701/2 |
| 2010/0326318 | A1 | 12/2010 | Baranowski et al. | |
| 2015/0130592 | A1 | 5/2015 | Lakshminarayanan et al. | |
| 2016/0122078 | A1 * | 5/2016 | Clark | B65D 19/44 108/55.3 |
| 2019/0283784 | A1 * | 9/2019 | Masterman | B61D 39/00 |
| 2020/0039538 | A1 | 2/2020 | Blum et al. | |
| 2020/0039739 | A1 | 2/2020 | Robichaux | |
| 2020/0156672 | A1 | 5/2020 | Andre et al. | |
| 2020/0189864 | A1 | 6/2020 | Campbell et al. | |

FOREIGN PATENT DOCUMENTS

| | | | | |
|---|---|---|---|---|
| CN | 100545017 | C | 9/2009 | |
| CN | 101823489 | B | 9/2011 | |
| DE | 1580956 | A1 | 3/1971 | |
| DE | 131162 | A2 | 6/1978 | |
| DE | 4322204 | A1 * | 1/1995 | B61D 3/04 |
| DE | 4332232 | C1 | 2/1995 | |
| DE | 29502141 | U1 | 4/1995 | |
| DE | 19503557 | A1 | 8/1996 | |
| DE | 4224829 | C2 | 10/1997 | |
| DE | 10014951 | A1 | 1/2001 | |
| DE | 10258405 | A1 | 5/2004 | |
| DE | 10361291 | B3 | 9/2005 | |
| EP | 0631918 | A1 | 1/1995 | |
| EP | 0987160 | A1 | 3/2000 | |
| EP | 2006224 | B1 | 3/2011 | |
| EP | 3699058 | A1 | 8/2020 | |
| EP | 3716288 | | 9/2020 | |
| EP | 3733573 | A1 | 11/2020 | |
| FR | 2409178 | A1 | 6/1979 | |
| FR | 2712725 | A1 | 5/1995 | |
| GB | 1034372 | A | 6/1966 | |
| NL | 2001214 | C2 | 7/2009 | |
| RU | 2374107 | C2 | 11/2009 | |
| RU | 208833 | U1 | 1/2022 | |
| WO | 91/10012 | A1 | 7/1991 | |
| WO | 98/55381 | A1 | 12/1998 | |
| WO | 00/48887 | A1 | 8/2000 | |
| WO | WO-0048887 | A1 * | 8/2000 | B60P 3/00 |
| WO | 00/78498 | A1 | 12/2000 | |
| WO | 01/38211 | A1 | 5/2001 | |
| WO | 02/081283 | A1 | 10/2002 | |
| WO | 2002076804 | A1 | 10/2002 | |
| WO | 2009/093893 | A1 | 7/2009 | |
| WO | WO-2009093893 | A1 * | 7/2009 | B61D 3/18 |
| WO | 2012/049633 | A1 | 4/2012 | |
| WO | 2012/109120 | A2 | 8/2012 | |
| WO | 2014/193242 | A1 | 12/2014 | |
| WO | 2015/007377 | A1 | 1/2015 | |
| WO | 2016/026001 | A1 | 2/2016 | |
| WO | 2016026001 | A1 | 2/2016 | |
| WO | 2018224959 | A1 | 12/2018 | |
| WO | WO-2021108874 | A1 * | 6/2021 | B61D 3/18 |

OTHER PUBLICATIONS

International Search Report and Written Opinion for International Application No. PCT/CA2023/051594 mailed Feb. 7, 2024 (15 pages).

* cited by examiner

RAILCAR SYSTEMS AND CARGO TRANSPORTATION METHODS

PRIORITY CLAIM

This application claims benefit of U.S. Provisional Patent Application No. 63/301,185, filed Jan. 20, 2022, which is incorporated herein by reference in its entirety for all purposes.

FIELD

The invention relates to cargo transport systems, cargo transport vessels that are used in combination with removable carriers that can be loaded and unloaded into the cargo transport vessel, and methods of using these systems, vessels, and removable carriers.

BACKGROUND

The movement of commercial goods between locations takes many forms. Sometimes referred to generally as "cargo transport," systems for moving goods affect the lives of most every individual on an everyday basis.

Systems for transporting goods must be efficient and cost effective. These systems work best when the containers that hold the cargo during transport (i.e. "cargo transport vessels") are loaded to a useful loading density, and are rapidly loaded and un-loaded. A number of different types of transport systems are designed around various types of cargo vessels, including railcars (including, recently, "autonomous" railcars), intermodal cargo containers, semi-trailers, ships, and airplanes. Each of these types of systems currently has identifiable inefficiencies, which—as identified by the Applicant—are opportunities to improve the overall efficiency and cost to move cargo.

Railway transport of cargo is a cost effective mode of moving goods from one location to another. But while modern railway shipping systems can be considered to be highly refined, well-organized, well-managed, and well-maintained, i.e., would be considered to operate at a high level of overall efficiency, which makes their use generally cost effective, railway cargo transport systems that are presently in use around the world can be shown to suffer from identifiable and substantial inefficiencies that are not presently appreciated or addressed by current rail systems.

Example inefficiencies take at least two forms: inefficient use of cargo space on railcars (individually and on average), i.e., undesirably low packing densities, such as below 70, 60, or 50 percent of a railcar; and inefficient methods used to load cargo onto and un-load cargo from enclosed railcars (e.g., boxcars), which primarily occurs by forklifts that carry single pieces of cargo onto and from the railcar through a side door of the enclosed railcar, i.e., by moving one piece of cargo at a time onto or off of the railcar.

Regarding the first form of inefficiency, low density packing of cargo containers, standard cargo containers (i.e, "intermodal" containers that may be transferred between a ship, train, or truck) are often loaded with pallets that have standard or common length and width dimensions of 40 inches by 48 inches. The dimensions of many of the world's existing intermodal cargo containers are not selected to allow for a highly efficient fit of multiple pallets across the width and length dimensions of the interior space of these standard cargo containers. Additionally, depending on the nature of cargo that is supported on a pallet, many pallets do not stack well and only a single horizontal level of pallets may be contained on a single horizontal level (floor) in a cargo container. Packing densities will vary based on types of cargo, but the packing density of cargo that is palletized and loaded into a shipping vessel often falls below 70, 60, or 50 percent by volume. "Packing density" (or "loading density") is a percentage value that is calculated as the volume of cargo per the total internal cargo space (volume) of a cargo container or any form of cargo transport vessel.

This inefficiency is exacerbated if, as is common, a complete cargo container is loaded in-bulk onto a railcar without unloading the cargo from the cargo container and re-loading the cargo more efficiently into an enclosed boxcar or other type of railcar. Commonly, one or more cargo containers are loaded directly onto a flatbed railcar, including all of the contents of the containers. The footprint of the cargo container, meaning the area taken up by the length and width dimensions of a standard cargo container, or a whole-number multiple thereof, may not match the area of a standard railcar. When one or more standard cargo containers are loaded onto a standard railway flatcar, a large segment of the area of the railcar may remain unused.

Packing density of the railcar is not necessarily improved by un-loading the cargo from the cargo container and re-loading the cargo to a railcar, such as an enclosed boxcar. Most boxcars in use today include a sliding door to access the interior. Boxcars are normally loaded through the side door using a forklift, by using the forklift to carry a single piece of cargo onto or from the railcar. Two forms of inefficiency result. A first is that the re-loaded railcar may still have a relatively low packing density, such as below 80, 70, 60, or 50 percent by volume. A second inefficiency is the manner of loading and un-loading the boxcar by forklift through a side-door. Loading a boxcar with cargo pallets using a forklift to load and unload individual pallets, one-at-a-time, through a side door of a boxcar, may take hours to complete. A typical railcar loading dock is capable of accessing and loading just one side of a train at a time, and often of accessing railcars of only one train at a time. Long cargo trains with dozens of cars must wait for each car to be loaded or un-loaded, or both.

The process of unloading and re-loading a train that includes dozens of boxcars, or more, may take hours or sometimes even a day or more. In addition to slow loading of cargo through a single side door, loading a boxcar also involves addressing a variety of other factors relating to safety, security, and the physical condition and integrity of the boxcar. Most boxcars are shared, not owned by a single owner-user. The condition of a boxcar is not maintained by a single owner and may suffer, particularly as to the condition of a door. Accordingly, loading a boxcar involves safety and mainenence procedures and inspections to ensure the safety of human operators and personnel involved with loading and un-loading the boxcar, and to ensure safe and secure transport of the cargo loaded to the boxcar.

Many similar inefficiencies may be present when loading and un-loading other types of cargo vessels through a side door or an end door, such as with intermodal cargo containers. Intermodal cargo carriers are loaded through doors at an end of the container and are often loaded at an inefficient packing density of below 70, 60, or 50 percent.

SUMMARY

Modern cargo transport systems would benefit from improved efficiency, safety, and security. Opportunities to improve overall efficiency of cargo transport systems exist in improved packing systems for cargo transport vessels (e.g., railcars, intermodal containers, and the like) (sometimes referred to herein as "cargo vessels" or "vessels" for short), to improve packing density of individual cargo vessels. Other opportunities to improve overall efficiency of cargo transport systems exist in improving methods of loading and un-loading cargo transport vessels.

The following describes cargo vessels and cargo vessel loading systems that improve the overall efficiency of a range of common types of cargo transport systems.

The invention relates to: cargo transport systems; top-loading cargo transport vessels that may be used in combination with removable carriers that can be efficiently loaded and unloaded through a top opening of a cargo transport vessel; and methods of using these systems, vessels, and removable carriers.

Useful cargo transport systems as described include a top-loading (a.k.a. "top-opening") cargo vessel that is designed to contain one or more removable cargo carriers (sometimes referred to herein as "removable carriers" or "carriers" for short) loaded with cargo. Each of the one or more cargo carriers can contain cargo at an efficient (e.g., high) packing density and can be efficiently loaded and un-loaded through a top opening of the top-loading cargo vessel, e.g., a top-loading railcar.

In certain example systems and methods, multiple multi-shelf cargo carriers can be pre-loaded with cargo at a high packing density, at a time before a train that carries a top-opening railcar designated for the cargo arrives at a loading station. Once the train arrives, the high-packing density, pre-loaded multi-shelf cargo carriers can be loaded through a top opening of the railcar. The operation of loading the carriers with pre-loaded cargo into the railcar through the top opening can take minutes as opposed to the hours that may be required to load a standard boxcar through a side door. Additionally, with a system of top-loading the railcars, multiple trains that carry top-loading railcars can be arranged in parallel, on parallel tracks, side-by-side, at a loading station. The operations for loading the multiple trains can all be performed at the same time.

In one aspect, the invention relates to a top-loading railcar. The railcar includes: a deck having a deck front, a deck back, and two deck sides; wheels supporting the deck; a front wall extending vertically from the deck front; a back wall extending vertically from the deck back; and two sidewalls extending vertically from each of the two deck sides; with the sidewalls and deck defining an interior. The railcar further includes a top opening at the top of the interior defined by a top of the front wall, a top of the back wall, and the tops of the two sidewalls, and a roof that is capable of an opened position that exposes the top opening and allows access to the interior, and a closed position that covers the top opening.

In another aspect, the invention relates to a method of placing cargo into a top-loading railcar. The railcar comprises: a deck, wheels supporting the deck, walls extending vertically from the deck to define a railcar interior, and a top opening at the top of the interior defined by a top of the walls. The method includes placing a removable cargo carrier through the top opening and into the railcar interior, with the removable cargo carrier supporting cargo.

In yet another aspect, the invention relates to a method of placing cargo into two or more top-loading railcars. Each top-loading railcar comprising: a deck, wheels supporting the deck, walls extending vertically from the deck to define a railcar interior, and a top opening at the top of the interior defined by a top of the walls. The method includes: with a first train on a rail line, the first train comprising one or more top-loading railcars; with a second train on a rail line parallel to the first train, the second train comprising one or more top-loading railcars; loading cargo through a top opening of a top-loading railcar of the first train; and loading cargo through a top opening of a top-loading railcar of the second train.

In yet another aspect, the invention relates to a top-loading cargo transport vessel. The includes: a deck having a deck front, a deck back, and two deck sides; a front wall extending vertically from the deck front, a back wall extending vertically from the deck back, and two sidewalls extending vertically from each of the two deck sides, the sidewalls and deck defining an interior; and a top opening at the top of the interior defined by a top of the front wall, a top of the back wall, and tops of the two sidewalls.

In yet another aspect, the invention relates to a method of placing cargo into a top-loading cargo transport vessel. The vessel includes: a deck, walls extending vertically from the deck to define a vessel interior, and a top opening at the top of the interior defined by a top of the walls. The method includes placing a removable cargo carrier through the top opening and into the railcar interior, with the removable cargo carrier supporting cargo.

In yet another aspect, the invention relates to a railcar. The railcar includes: railcar container that is supported by wheels on an axel; a generator mechanically connected to the axel or a wheel, the generator adapted to generate electricity based on movement of a wheel or axel of the railcar; a battery connected to the generator; and electronic devices connected to the generator, the battery, or both, the electronic devices comprising a computer processor.

Figure 1A:
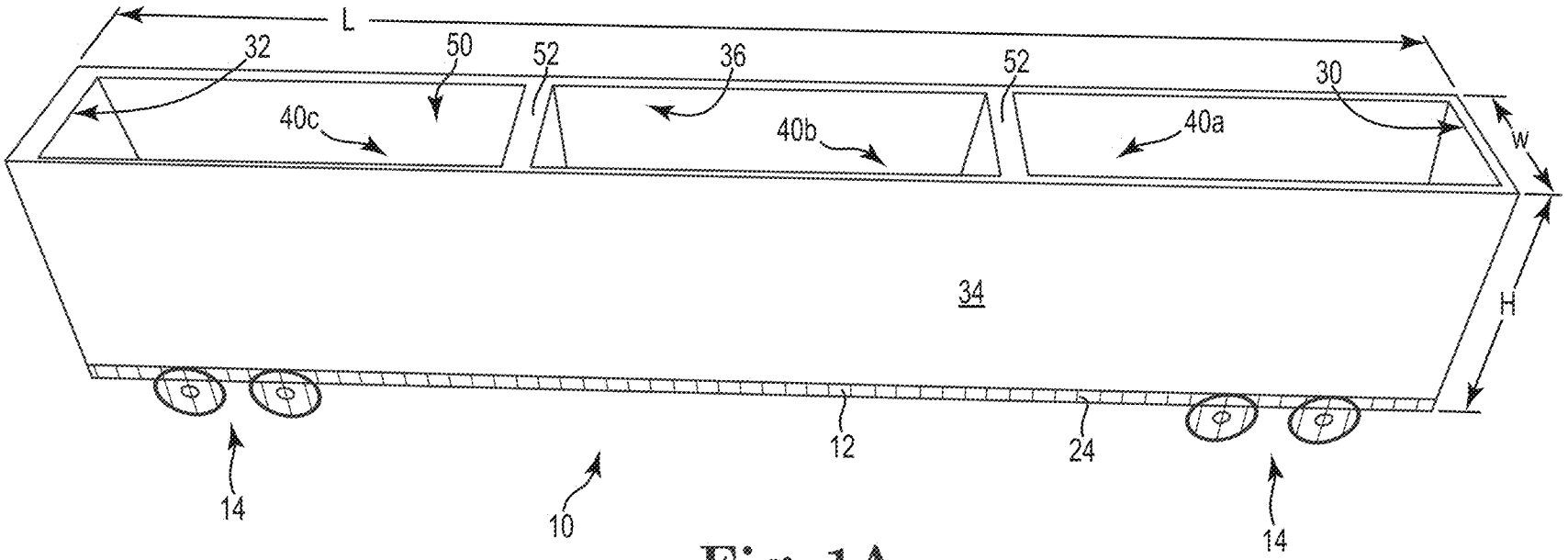
FIGS. 1A (top-perspective view), 1B (side-perspective view), 1C (side-perspective view), and 1D (top-perspective view), show an example of a top-loading cargo vessel of the present description, and removable carriers.

All figures are schematic and are not necessarily to scale.

DETAILED DESCRIPTION

Described as follows are cargo transport systems that use a top-loading cargo transport vessel (sometimes referred to herein as a "top-loading transport vessel," or "cargo transport vessel," "cargo vessel," or "vessel," or the like, based on context) that can be used to carry one or more removable carriers. The removable carriers, loaded with cargo, may be loaded and unloaded into and from the cargo transport vessel through a top opening of the cargo transport vessel. Also described are methods of loading and unloading a removable carrier into or from a cargo vessel of a system, and methods of moving and transporting cargo using the system.

A feature of the described systems is a combination of a top-loading cargo vessel and one or more removable cargo carriers (sometimes referred individually to as "removable carrier" or just "carrier," for short) that can be loaded with cargo, contained in an interior of the cargo vessel, transported by the vessel, then removed from the vessel to remove the cargo.

A top-loading cargo vessel is a vessel of the type that is useful to transport cargo from one location to another by rail, roadway, ship, airplane, truck, or by another mode of transportation, but differs from currently-used or conventional vessels of these types by including a top opening that allows a removable cargo carrier to be placed into and removed from, i.e., loaded and un-loaded, into and from, the vessel through the top opening.

Example top-loading cargo vessels include vessels that may have design features in common with conventional railcars (either a self-powered autonomous railcar or a standard non-autonomous railcar), intermodal cargo vessels, and self-powered autonomous cargo vessels designed for over-the-road transport, and that are constructed to include a top opening that allows for loading and un-loading removable carriers to and from the vessel. A vessel may be powered or un-powered, e.g., may be moved by a different vehicle such as a truck, train, ship, or locomotive, or may be powered by a self-contained power source as with "autonomous" railcars. The power source may be any useful power source, such as an electric motor powered by a re-chargeable battery, or a gas or diesel-powered motor. Alternately or additionally, a vessel may include electronics such as a global-positioning tracking system and a communication system to remotely guide or track the vessel.

A top-loading cargo vessel as described includes a horizontal base, vertically-extending wall structures (sidewalls, a frontwall, and a backwall), a top opening and interior between the wall structures, and a roof (which is optional), i.e., any type of cover for the top opening or to otherwise cover and protect carriers within the vessel interior. These structures define the vessel interior ("interior" for short) that is located between the walls and horizontal base.

A roof (which refers to any type of cover, generally, that covers the top opening) of a top-loading cargo vessel is "removable," meaning that the roof is capable of an opened position that exposes the top opening and the interior and allows access to the interior for loading and un-loading the interior through the top opening, and also is capable of a closed position that covers the interior or top opening and optionally encloses and secures the interior.

An example roof may be a solid roof that securely encloses the vessel interior, such as a metal lid that opens and closes by sliding or lifting (e.g., hinged or un-hinged) to selectively expose and cover the vessel interior. Other examples of a roof structure include a flexible, air-permeable cover such as a sheet of fabric or mesh (metal, polymeric, or otherwise) that can be un-rolled and rolled to cover and un-cover the top opening of the vessel.

Alternative roofs may be any other structure that covers and protects contents of a removable cargo carrier that is contained within the cargo transport vessel. The roof may be attached to and move with the cargo vessel, or may be attached to and move with the removable carrier, for example by being incorporated into the structure of the carrier. If desired, a roof of the cargo transport vessel may be a structure of a carrier that covers the top of the carrier while the carrier is positioned within the vessel, such as a cover that covers the carrier and takes up or covers at least a portion of the top opening of the vessel. This example of a roof structure can be attached to an upper portion of the carrier and may move with the carrier, and need not be attached to a wall structure of the vessel.

Other than the top opening, no other openings or doors are required in a cargo vessel to allow access to the vessel interior for loading cargo. A top-loading cargo vessel of the present description does not require and may optionally exclude a door on a sidewall or endwall of a type and size that is useful to load and unload cargo to or from a cargo vessel, such as by using a forklift to drive pallets to the interior of the vessel. Still, other openings may be included if needed, e.g., for purposes other than loading cargo into the vessel interior.

A top opening as described is an open space at a top of a cargo vessel between the upper walls that allows access through the top of the vessel to the vessel interior and is of sufficient size to pass a removable cargo carrier through, to fully load the vessel interior with cargo that has been pre-loaded into the removable cargo carrier. The top opening may extend a substantial or an entire length of the two sidewalls, the front wall, and the back wall; the top opening preferably allows for vertical access to all space within a vessel interior so that a cargo carrier may be loaded by lowering the carrier in a vertical direction from above the vessel, through the top opening, and into the vessel interior.

A top-loading cargo vessel may be supported by permanent or removable wheels beneath the deck, and a suspension system between the deck and the wheels. A wheel assembly may include multiple axels, a carriage or "bogie," springs, shock absorbers, brakes, and wheels. The wheels may be metal wheels for engaging a railroad, or wheels for transport over a road that include rubber tires comparable to those of a semi-trailer. The cargo vessel may have a mode of propulsion such as a motor to engage and drive the wheels. The motor may be powered by a battery, a gas or diesel engine, or by another mode of propulsion.

A top-loading cargo vessel does not require and can specifically exclude horizontal separators or additional (i.e., other than the deck) supportive decks, shelves, or "floors" that are not of a removable design as part of a removable cargo carrier as described herein and designed to be loaded and un-loaded as part of a removable carrier through a top opening of the railcar. Other than as part of a removable carrier, a cargo vessel as described can exclude any permanent or non-permanent horizontal separators that extend horizontally along the width and length of the vessel and separate the vessel interior into vertical spaces to provide multiple levels of horizontal support for cargo. In place of such horizontal separators, a vessel can use removable cargo carriers as described, that may have multiple supportive horizontal levels to support multiple horizontal levels of cargo and are adapted to be loaded and un-loaded through a top opening of the vessel.

The vertical walls of the top-loading cargo vessel are preferably permanent and are not moveable or removable. The walls may be of rigid materials commonly used in cargo vessels (e.g., truck trailers, railcars, intermodal containers), such as steel that may be reinforced to support the vertical orientation of the walls in the absence of a supportive roof structure, and optionally to support a removable roof located at the top of the walls to cover a top opening. Each wall can be permanently secured to an adjacent wall at two corners of the vessel, and each wall is permanently secured to the base. By being "permanently secured," the walls are secured to the base and adjacent walls by welding or in a comparably permanent fashion, and are designed and intended to remain secured to the base and adjacent walls of the vessel for a period of a useful lifetime of the vessel, and are not adapted to be removable for any purpose related to the use of the vessel, such as for allowing cargo to be loaded onto or removed from the vessel.

Each wall can be a structure that attaches to the base and extends vertically upward to define a side of a space above the base, the space being generally referred to as an "interior" of the vessel. A wall may partially or completely enclose the interior, e.g., may include small or large openings, or may be continuous with no openings. Example walls are continuous heavy-duty vertical sheets of metal of the type found on commercial boxcars and intermodal shipping containers. Other examples of walls may be in the form of a rigid frame that extends vertically from the base to an upper opening to form a side of an interior of the vessel, and that contains openings between members of the frame; the openings may be sized to allow visual access of the vessel interior from the vessel exterior (i.e., contents within the interior may be visible from the exterior), while not necessarily being large enough to allow cargo to be passed through the openings. Still other walls may include a frame with openings formed between members of the frame, and a covering made of a metal or lighter-weight non-metal material such as fiberglass or a different composite, e.g., a carbon composite, that covers the openings in the frame and encloses the vessel interior.

In one example format, the invention relates to a top-loading cargo vessel in the form of a top-loading railcar, to a top-loading railcar that is used with and contains one or more removable cargo carriers, to trains and railyards that use and contain the top-loading railcars and removable cargo carriers, and to methods of loading, un-loading, and using the top-loading railcars and removable cargo carriers to transport cargo between two locations on a rail line. (The descriptions of features of an example top-loading cargo transport vessel in the form of a top-loading railcar describes various features of an inventive top-loading railcar. Many or all of these same features will be understood to be useful not only when included in a top-loading railcar, but also will be understood to be useful with other forms of top-loading cargo transport vessels, some of which are described herein, as well as others that will be recognized by the description of the example top-loading railcar design.)

A top-loading railcar (or other type of top-loading cargo vessel) as described includes a horizontal base (a.k.a., "deck") and vertically-extending wall structures (sidewalls, a frontwall, and a backwall). A preferred railcar may also include a roof and a structure at the bottom of the cargo-carrying interior to weatherproof the cargo area from below. These structures define space inside of the railcar that can hold cargo for transport, referred to as a railcar interior ("interior" for short), that is located above the base and within the walls that surround the base.

The railcar can have any dimensions, but common dimensions of current commercial railcars (e.g., boxcars), and dimensions that will be useful for example top-loading railcars as described, have one or more of: an interior length in a range from 40 to 100 feet (this may vary widely); an interior width in a range from 8 to 11 feet (e.g., from 9 to 10 feet); and an interior height in a range from 15 to 30 feet.

A top-loading railcar may optionally have a roof, which is "removable," meaning a roof that is capable of an opened position that exposes a top opening that leads to the interior and allows access to the interior for loading and un-loading cargo into the interior, and also is capable of a closed position that covers the top opening, secures the interior, or both. Other than the top opening, no other openings or doors are required to allow access to the railcar interior. If desired, a top-opening railcar (or other type of top-opening vessel) may not include a roof or other cover to be placed over the top opening.

A top opening as described is an open space at a top of a railcar between the walls that allows access through the top of the railcar to the railcar interior and is of sufficient size to pass a removable cargo carrier through, to fully load the railcar interior with cargo. The top opening can preferably extend a substantial or an entire length of the sidewalls, the front wall, and the back wall. A significantly smaller opening in a roof of a railcar such as a hatch, door, or port that is sized, for example, to allow only a person but not a full load of cargo to pass into the interior, is not considered to be a top opening. Also, a top-opening railcar as described does not include certain conventional types of railcars that are permanently open at the top and that have other features that are different from a top-loading railcar of the present description. For example, top-opening railcars of the present description do not include railcars that do not have a flat interior base and four substantially vertical walls that enclose an interior, e.g., do not include: an open-topped bin-type railcar (having a sloped bottom and doors), a hopper car (having a sloped bottom and doors), a well car, a gondola, or a center-beam type of railcar that may be used to transport materials in an un-covered, non-enclosed environment.

Except as noted with respect to the inventive top-loading railcars, other than the top opening and removable roof, the structures, materials, and dimensions of example top-loading railcars may be the same as the materials, structures, and dimensions of conventional, standard, enclosed commercial railcar structures typically referred to as "boxcars," that include a permanent roof and a side door. Certain example top-loading railcars may be considered to be modified boxcars, and will have many features in common with a standard boxcar. These may include one or more of: substantially vertical walls; a substantially horizontal (flat) roof and substantially horizontal (flat) deck; a completely open interior with a cross section that is open and rectangular along the height axis, entirely from roof to deck; the interior also having a cross section that is open and rectangular along the width axis, entirely from side to side; the interior also having a cross section that is open and rectangular along the length axis, entirely from front to back; a horizontal flat bottom that does not include sloped sides or openings to allow for un-loading through the bottom (e.g., as with a covered hopper). Also like a standard boxcar, examples of top-loading railcars of the present description may be fully enclosed and can be secured from unauthorized breach or entry, with walls that are continuous and solid, not designed to be apertured or opened to the exterior other than through small or minor gaps between portions of the railcar structure.

Likewise, other than the top opening, the structures, materials, and dimensions of other versions of top-loading vessels such as intermodal cargo containers, autonomous vessels for use on a rail line or for over-the-road transport, or the like, may be the same as the materials, structures, and dimensions of conventional, standard, enclosed commercial structures of these types of vessels.

To support the walls of an open-top, top-loading railcar without the benefit of structural support from a permanently secured roof that is connected to the walls, additional support or reinforcement for the wall structures may be included. The walls, the deck, and support members of a top-loading car can be made of materials such as wood, heavy gauge steel, or lighter weight composite materials such as fiberglass or carbon composites, as desired.

Wheels and supports for the top-loading railcar can be sized and made of materials that are conventionally used on currently-commercial railcars. The railcar can include a conventional coupler centrally mounted at each of the front and back (rear) ends of the railcar along a longitudinal axis thereof. Other remaining components of a standard, commercial railcar that are usually mounted underneath the deck (or "base"), such as brakes, impact force cushioning devices, brake pipe, and the like, are not described in detail herein for the sake of brevity, but can be included on the top-loading railcar.

An autonomous version of a railcar does not require two couplers, or even one coupler, and may include a power source (e.g., battery) to drive the wheels, and electronics and communications for navigation, such as a global positioning system (GPS) and cell-tower communications for sending and receiving locations to a remote system that tracks and directs movement of the railcar. Example communication systems include electronic devices to transmit information relating to items such as a location of the railcar, and to receive navigation instructions that control movement of the railcar. With these communication systems, the movement of the autonomous railcar can be controlled and tracked remotely.

As one difference between current commercial railcars (or other cargo transport vessels) and a top-loading railcar (or other top-loading vessel) of the present description, the top-loading railcar does not require and may optionally exclude a door (e.g., a sliding door having a height approximately the same as the railcar) or other opening formed in or as part of a sidewall along the length of the railcar, of a type and size that is useful to load and unload a conventional railcar, such as by using a forklift to drive pallets to the interior of the railcar.

Likewise, the top-loading railcar (or other type of top-loading vessel) also does not require and may specifically exclude a door in an endwall (frontwall or back wall) of a type and size that is useful to load or unload the car, e.g., by using as forklift or by otherwise loading cargo through an end of the railcar.

Furthermore, example railcars (or other top-loading vessel) can have a permanent flat base that extends over the entire area of the interior, substantially vertical walls along the entire height of the railcar, and do not require and can specifically exclude horizontal separators or additional supportive decks or "floors" that are not of a removable design of a cargo carrier as described herein, i.e., designed to be loaded and un-loaded through a top opening of the railcar.

The invention also relates to methods of using top-loading cargo transport vessels, including but not limited to railcars, autonomous cargo transport vessels, intermodal cargo transport vessels, and the like, and to methods of loading and unloading top-loading cargo transport vessels by loading and un-loading cargo supported on a removable cargo carrier through the top opening of the vessel. Generally, one or more removable cargo carriers can be loaded through the top opening, optionally by placing a removable roof in an opened position to expose a top opening of the vessel to allow access to the vessel interior. A removable roof may be placed into an opened position by removing the roof, or roof sections, or by pivoting the roof, or section on a hinge between the roof and a sidewall of the vessel, or by sliding the roof, or section, in a direction of a length of the railcar. Cargo carried by a removable carrier can be loaded through the top opening of the vessel and into the vessel interior. After the cargo is placed at the vessel interior, the roof can be placed in a closed position to cover or secure the vessel interior.

The top-loading vessel is adapted to contain one or more removable cargo carriers that can carry cargo that is preferably packed with a high packing density, and that closely fit into interior dimensions of the vessel. A removable cargo carrier is a support for cargo that can be loaded and un-loaded into the top-loading vessel through the top opening, and that carries an amount of cargo that can provide for a useful packing density, preferably a high packing density, of the top-loading vessel.

Generally, a removable cargo carrier can be any structure that can support cargo (any type), and that can also be placed into and removed from an interior of a cargo transport vessel through a top opening. In particular examples, a removable cargo carrier includes a vertical frame made up of vertical frame supports, a bottom, an interior within the frame, and optionally one or more horizontal shelves supported by the frame. The carrier can have an enclosed interior that is defined by four closed sides, a closed bottom, and a closed cover, and which may be opened at one of the top, bottom, or sides for loading and unloading. Alternately, the carrier can have an open, multi-shelf structure that has multiple shelves and sides that are open to allow access to and loading of the shelves.

A removable cargo carrier can optionally include multiple horizontal shelves that are supported by multiple vertical frame supports (a.k.a., a "frame" or "vertical frame"). The shelves and frame supports may be constructed and reinforced as needed to support a load of cargo on each shelf. The shelves and frame supports may be made of any useful material, such as wood, aluminum, iron, heavy gauge steel, or lighter weight composite (e.g., non-metal) materials, as desired and effective.

The use of the removable cargo carriers allows for loading the top-loading vessel at a high packing density, and also allows for efficient (e.g., fast and effective) loading and un-loading of a top-loading vessel.

To provide high packing density, the removable cargo carrier has dimensions that are sized to closely fit the interior of the vessel, or a segment of the vessel. The dimensions of the removable cargo carrier refers to the overall height, width, and length of a removable cargo carrier.

To provide for efficient loading density of a top-loading cargo transport vessel, the removable cargo carrier can have a width that is slightly less than a width of an interior of the top-loading vessel, e.g., a removable cargo carrier may have a width that is less than 100 percent of a width of a top-loading cargo transport vessel interior, but that is at least 80, 85, 90, or 95 percent of the width of the vessel interior.

The removable cargo carrier may have a length that is slightly less than a length of an interior of the top-loading cargo transport vessel or a segment thereof. A removable cargo carrier may have a length that is less than 100 percent of a length of a vessel interior or interior segment, but that is at least 80, 85, 90, or 95 percent of the length of the vessel interior or interior segment. In some example systems, a top-loading vessel interior may be separated into multiple (e.g., two, three, or four) segments along the length of the vessel. Each segment has a length that is a portion of a total length of the vessel, e.g., that is approximately one-half, one-third, or one-fourth of the total length of the vessel. For these top-loading vessels, having multiple interior segments, a removable cargo carrier may have a length that is less than 100 percent of a length of a segment of the vessel interior, but that is at least 80, 85, 90, or 95 percent of the length of the segment of the vessel interior.

Also to provide efficient loading density of the top-loading cargo transport vessel, the removable cargo carrier can have a height that is slightly less than a height of an interior of the top-loaing vessel, e.g., a removable cargo carrier may have a height that is less than 100 percent of a height of a vessel interior, but that is at least 70, 80, 85, 90, or 95 percent of the height of the vessel interior.

Considered differently, a removable cargo carrier may have a footprint area that is at least 70, 80, 85, 90, or 95 percent of the deck interior footprint area of a top-loading vessel, or of a segment of the deck for a vessel that is separated into two or more interior segments.

In terms of particular examples of useful dimensions, in an example combination of a top-loading vessel and removable cargo carrier, the vessel interior can have a width that is not more than 1, 2, or 3 feet greater than the width of the removable cargo carrier. Additionally or alternately, the vessel interior or a segment of a vessel interior can have a length that is not more than 1, 2, 3, or 5 feet greater than the length of the removable cargo carrier. Additionally or alternately, the vessel interior can have a height that is not more than 1, 2, 3, or 5 feet greater than the height of the removable cargo carrier.

A removable carrier can be in the form of a single assembly, i.e., a "single-piece" removable carrier, meaning a removable carrier that includes a single, integrated, vertical frame that is of a height that substantially fills the height of a vessel interior. The single-piece carrier may include a bottom horizontal support (sometimes referred to as a "bottom shelf") and one or more additional shelves supported at different heights by the vertical frame. The carrier may be open laterally along the sides and ends to allow loading and un-loading of shelves laterally through an open side or open end, or may be enclosed on the sides and ends, with loading and un-loading being allowed through a top or bottom opening. See FIG. 3F.

A single-piece removable carrier can be pre-loaded with cargo before the carrier is loaded into an interior of a vessel. The pre-loaded carrier can be loaded as a single carrier, in one step, through a top opening of a vessel, into an interior space of a vessel to essentially fill the height of the vessel.

Example carriers can include multiple horizontal shelves, only one shelf (in addition to a bottom horizontal support surface or bottom shelf), or no shelves but only a bottom horizontal support. The number of shelves of a carrier can be selected based on the heights of cargo pieces that are loaded onto each shelf. The vertical location of shelves as part of a carrier may be permanent, i.e., fixed, or may be selectable or moveable to selected vertical positions along the height of vertical frame supports.

Example shelves may be removable from a frame of a carrier to allow cargo to be loaded onto the shelf at a location that is away from the carrier frame, and to allow the height position of the shelf along the vertical frame supports to be selected based on a height of cargo pieces loaded onto the shelf. A removable shelf may be removed from the frame of the carrier and cargo can be loaded onto (or un-loaded from) the shelf at a location that is away from the frame. The shelf can then be replaced within the vertical frame supports, optionally at a height of the vertical frame supports that is selected based on the height of cargo pieces that are carried by the shelf. See, e.g., FIGS. 5A, 5E, 5F, and 5G.

Another type of carrier may be constructed using vertical frame supports, a bottom horizontal support at the bottom of the frame, an optional horizontal top at an upper location of the frame, and no horizontal shelves supported by the frame between the top and bottom of the vertical frame. An example of this type of carrier is an enclosed carrier or "carrier bin" that has an interior defined by four sidewalls and the bottom, and a top opening (with an optional removable roof or cover) that allows cargo (e.g., an aggregate material) to be loaded into the carrier bin through the top opening. The bottom (bottom horizontal support) supports the cargo contents of the carrier during use (e.g., movement) of the carrier, and may be opened to unload the contents from the carrier through a bottom opening. See, e.g., FIG. 3F.

A frame of a removable carrier may be made of a single, integrated vertical frame that has a height to substantially fill a full height of a vessel interior. In other examples, a frame of a removable carrier may instead be made of multiple separate pieces ("stackable carrier pieces") that support one or more shelves or a bottom support. The multiple carrier pieces, when stacked, have a total height that substantially fills a full height of a vessel interior, when the stacked pieces are loaded into the interior. Outside of an interior of a cargo transport vessel, each stackable carrier piece may be handled and loaded individually. See, e.g., FIGS. 3D and 3E.

A multi-piece, stackable removable carrier can include multiple separate vertical pieces, each piece having one or more horizontal shelves supported by vertical frame supports. Cargo can be loaded onto the shelves of each of the multiple pieces at a location separate from the vessel. Once the stackable carrier pieces have been loaded to contain cargo, the stackable pieces can be loaded, either individually or together, into an interior space of a top-loading vessel. Two or more pieces of a multi-piece, stackable, removable carrier can be contained in the stacked configuration within the vessel interior and have a total height (of the carrier) to essentially fill the height of the vessel interior. A total height of a multi-piece stackable carrier is the same as described, to fill space within the cargo vessel, but the multi-piece stackable carrier can have multiple pieces that can be handled separately and then stacked together within an interior of a cargo vessel.

The invention also relates to methods of loading cargo onto one or more removable cargo carriers for transport of the cargo within a top-loading cargo transport vessel as described, preferably with the cargo being efficiently loaded on the removable cargo carriers, which are then efficiently contained and transported by a cargo transport vessel. By example methods, a cargo carrier can be loaded with pallets or other forms of cargo, and the loading density (a.k.a., "packing density") of the cargo on the removable cargo carrier may be in excess of 60, 70, 75, 80, 85, or 90 percent. Loading density (or "packing density") of a removable cargo carrier is calculated as the amount of space of cargo loaded on the cargo carrier per total volume of the cargo carrier calculated as the length, width, and height of the cargo carrier.

One or more removable cargo carriers loaded with cargo at an efficient or high packing density can be loaded into a top-loading cargo transport vessel to produce a vessel that is loaded with cargo also at a usefully efficient or high total loading density of the cargo transport vessel. In example systems, cargo can be loaded onto one or more removable cargo carriers to a loading density of at least 60, 70, 75, 80, 85, or 90 percent; the pre-loaded one or more carriers can then be placed within (loaded into) a top-loading cargo transport vessel; the loading density of the top-loading cargo transport vessel may also be at least 60, 70, 75, 80, 85, or 90 percent.

A high loading density can also allow a cargo transport vessel to be loaded at a weight that approaches a limit of a nominal weight capacity for the type of vessel. For a vessel that is a railcar, the railcar may be loaded at an efficient total weight relative to a nominal capacity (nominal weight capacity) of a railcar allowed to be carried on a particular rail line. An example weight capacity of a railcar may be 286,000 gross rail load (GRL). For a tare of approximately 66,000 pounds, a nominal capacity (by weight) may be 220,000 pounds or 110 tons. For a train that contains multiple top-loading railcars loaded with removable carriers, at least 50, 60, 70, 80, or 90 percent of all top-loading railcars of the train may be loaded to a loading density of at least 60, 70, 80, or 90 percent of a nominal capacity (by weight).

For cargo transport vessels of different types and sizes (e.g., railcars of other dimensions, intermodal containers, autonomous cargo transport vessels, etc.), a nominal weight capacity will be accordingly different. According to example systems and methods of the present description, a top-loading cargo transport vessel loaded with removable carriers as described (with the removable carriers having a high packing density) may be loaded to at least 60, 70, 80, or 90 percent of a nominal capacity (by weight) for the type of cargo transport vessel.

In example methods, cargo pieces can be loaded onto a removable cargo carrier in a manner to place a center of gravity of the loaded cargo carrier at a relatively low position of the removable cargo carrier, e.g., below a location of 50 percent of the height of the loaded cargo carrier, e.g., below a location of 45, 40, 35, or 30 percent of the height of the loaded removable cargo carrier. When one or more of these removable cargo carriers, loaded with cargo, are loaded onto a railcar, the railcar (the total weight of the car and the loaded cargo) can also have a low center of gravity, e.g., a center of gravity that is below 50 percent of the height of the railcar, e.g., below a location of 45, 40, 35, or 30 percent of the height of the railcar (measured from the top of the rail to the top of the roof).

When the cargo transport vessel is a top-loading railcar, the removable carriers can be selectively loaded to achieve a low center of gravity, as mentioned, and to also place the center of gravity of the loaded railcar (including the total weight of the load) at a required level, even while achieving a high loading density. A required maximum of a center of gravity of a railcar will be a feature of a particular railcar and may be governed by standards, regulations, or a body such as the Association of American Railroads (AAR). A maximum center of gravity for a particular car, from any of these sources, can be determined based on the design of the car, including the weight and weight distribution of the unloaded railcar. A maximum center of gravity for a boxcar, as loaded, may 98 inches, 104 inches, or 108 inches above a top of a rail. According to systems and railcars of the present description, a railcar may be loaded to at least 70, 80, or 90 percent of a nominal capacity (by weight), while still having a center of gravity that is below a required maximum height, such as below 98 inches, or below 104 inches, or below 108 inches above a top of a rail that supports the railcar.

Each of the one or more cargo carriers can contain cargo at an efficient (e.g., high) packing density and can be efficiently loaded and un-loaded through a top opening of a top-loading cargo transport vessel.

In certain presently-preferred systems and methods, a multi-shelf removable cargo carrier can be pre-loaded at a high packing density at a location (a "cargo carrier loading station") that is near a location (e.g., a "loading station" or a "train loading station") at which the cargo carriers will be loaded into a cargo transport vessel, e.g., a railcar of a train. The cargo carriers can be loaded with cargo at the cargo carrier loading station at a time before a cargo transport vessel (e.g., train) into which the removable cargo carriers will be arrives at a nearby loading station, such as a train loading station.

While portions of the following described example of a loading system and method involve a top-loading cargo transport vessel that is a railcar of a train, features of the loading system and method can be applied to other types of top-loading cargo transport vessels. In more detail, a collection of removable cargo carriers can be loaded with cargo at a cargo carrier loading station at a railyard or other location. The cargo can be loaded onto the cargo carriers by any useful method, such as by use of a lift (e.g., forklift), and elevator, by hand, by robot, etc., optionally by pre-loading a shelf that has been removed from the frame of the cargo carrier and then placing the shelf loaded with cargo pieces onto the frame. Each cargo carrier can be preferably loaded with cargo at a packing density that is at least 60, 70, 80, or 90 percent. The cargo on each cargo carrier can be recorded and inventoried to track all cargo from the cargo carrier loading station to a particular railcar on a particular train, or to a different type of cargo transport vessel, along a route to a final destination of the cargo.

Once a train and top-loading railcar arrives that is designated to transport one or more particular removable cargo carriers (i.e., the cargo loaded thereon), the high-packing density, pre-loaded removable cargo carriers can be loaded through a top opening of the designated train or railcar. The removable cargo carriers may be placed (loaded) into the top-loading railcar through the top opening, and removed from the top-loading railcar, by any useful method, which may be a crane such as a gantry crane or a smaller-type of crane, self-powered crane, container mover, Reach-Stacker, or purpose-designed mechanism.

The technique of loading one or more railcars (or a different type of top-opening vessel) through a top opening of the railcar (or other type of top-opening vessel) can be completed in a matter of minutes as opposed to hours or days that may be required to load a single or multiple standard boxcars through a side door (or to load one or more of a different type of cargo container through a side door or an end door). Additionally, with a system of top-loading the railcars (or other vessel type), multiple trains (or other vessel types) can be arranged in parallel, on parallel tracks, side-by-side, at a loading station. The operations for loading the multiple trains can all be performed at the same time.

Using a top-loading method of placing pre-loaded removable cargo carriers into an interior of a top-loading vessel, the loading process is much more efficient compared to standard methods of loading pallets of cargo through a side door or end door of an enclosed boxcar, intermodal container, or the like.

Referring to FIGS. 1A, 1B, 1C, 1D, and 2A, 2B, and 2C, illustrated are example top-loading vessels of the present description. The illustrated example vessels are described as top-loading railcars (sometimes referred to herein as "railcars," "top-loading railcars," or the like). While example vessels are identified as a railcars (e.g., railcar 10), many general and specific structures, materials, and features (other than railway wheels and specific dimensions) that are described as useful with the illustrated railcars and their methods of use may be useful with other types of top-loading cargo transport vessels such as with a top-loading intermodal container, an autonomous container, or the like, with the wheels and suspension of an intermodal or autonomous container being appropriate for that type of vessel.

As illustrated, railcar 10 has a base or "deck" 12 that includes a top surface within an interior of the railcar and a bottom surface on the underside of deck 12, toward the ground, spaced apart from the top surface by a thickness of the base 12. The top surface of the deck can be substantially flat and continuous over the surface between the walls of the railcar, and does not require and can exclude any openings or slanted surfaces. The deck may be made from and supported by a rigid railcar material such as steel, and may reinforced to exhibit strength that is sufficient to support a load of one or more removable cargo carriers (as described herein), with the cargo carrier or cargo carriers being loaded with pallets or other cargo.

Deck 12 includes segments that can be referred to as a deck front 20 extending along the entire width of the railcar a forward (or "front") end of the deck and railcar, a deck back 22 extending along the entire width at a back (or "rear") end of the deck and railcar, and two deck sides 24 and 26 extending along the entire lengths of opposite (left and right) sides of the deck and the railcar. The deck can be flat and level between the back, front, and sides.

Example railcar 10 includes removable (meaning either movably hinged, sliding, or completely removable, i.e., detachable) roof 70 that can be moved or removed to expose interior 40 (or interior segments thereof) to allow loading and un-loading of one or more removable cargo carriers into or from interior 40.

Two railcar wheel sets 14 (four wheels and two axels per set or "bogie") are mounted near the front end and the back end of the bottom surface of deck 12 or otherwise underneath base 12 to support base 12 along rails of a railroad.

As illustrated, a railcar 10 does not require and may specifically exclude a door (e.g., a sliding door having a height approximately the same as the railcar) or other opening formed in or as part of the deck or of a sidewall or a frontwall or a backwall, and that is of a type and size of opening that is useful to load or unload, or both, a conventional railcar, such as by using a forklift to drive pallets to the interior of the railcar.

A railcar 10 has a length (L), a width (w), and a height (h) in the directions indicated. A front wall 30 extends vertically and along the height of railcar 10, and horizontally along the width of the deck front 20. A back wall 32 extends vertically and along the height of railcar 10, and horizontally along the width of deck back 30. Two sidewalls 34 and 36 extend along the length of railcar 10 and deck sides 24 and 26, and vertically from each of the two deck sides 24 and 26. The front wall, back wall, and sidewalls are sometimes referred to collectively herein as "walls" of the railcar. The walls, deck, and top opening 50 or roof 70 of the railcar define interior 40, which is enclosed when roof 70 is in a closed position. Moving or removing (detaching) removable roof 70, i.e., placing roof 70 in an opened position, exposes top opening 50 of railcar 10. Roof 70 in an opened position exposes top opening 50, defined by a top of front wall 30, a top of back wall 32, and the tops of sidewalls 34 and 36.

The walls and roof 70 of the railcar, including front wall 30, back wall 32, and sidewalls 34 and 36, may be made of rigid railcar material such as steel reinforced to support the vertical orientation of the walls and to support a roof located at and supported by the top of the walls. Each wall can be permanently secured to an adjacent wall at two corners of the railcar, and is permanently secured to base 12. The illustrated permanently secured walls are secured to the base by welding or in a comparably permanent fashion, and are designed and intended to remain secured to the base of the railcar for a period of a useful lifetime of the railcar, and are not adapted to be removable and replaceable for any purpose (other than potentially for maintenance), such as for allowing cargo to be loaded onto or removed from the railcar.

Figure 2A:
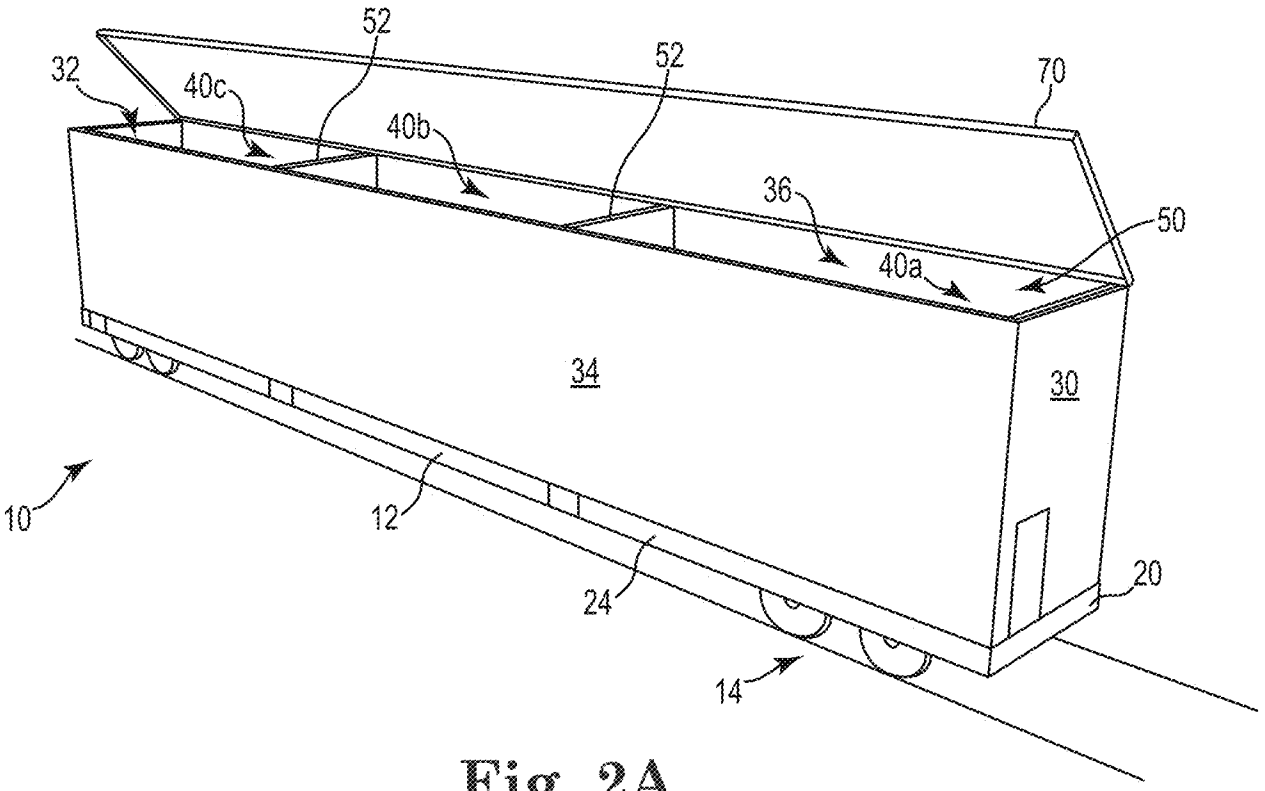
FIGS. 2A (top-perspective view), 2B (side-perspective view), and 2C (end view), show an example of a top-loading cargo vessel of the present description.

In certain examples, a railcar 10 can optionally include vertical separators 52 to separate interior 40 into two or three or more separate segments or compartments, typically along the length of railcar 10. For example, FIGS. 1A and 2A show vertical separators 52 separating interior 40 into a front segment 40*a*, a middle segment 40*b*, and a back segment 40*c*. Separators 52 may be permanent, removable, or may be moveable to different length-wise positions along the length of railcar 10.

Figure 1B:
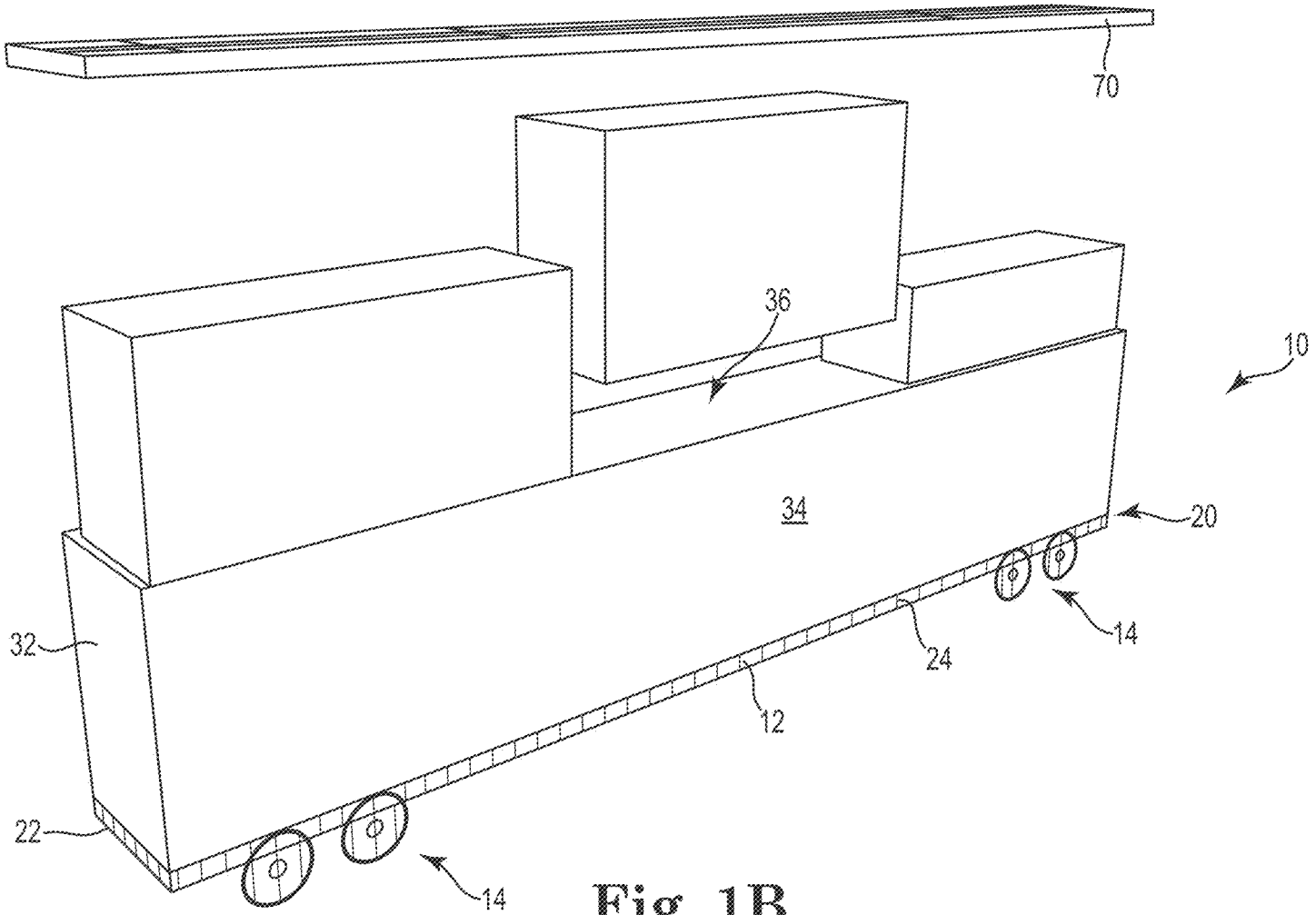
Figure 1C:
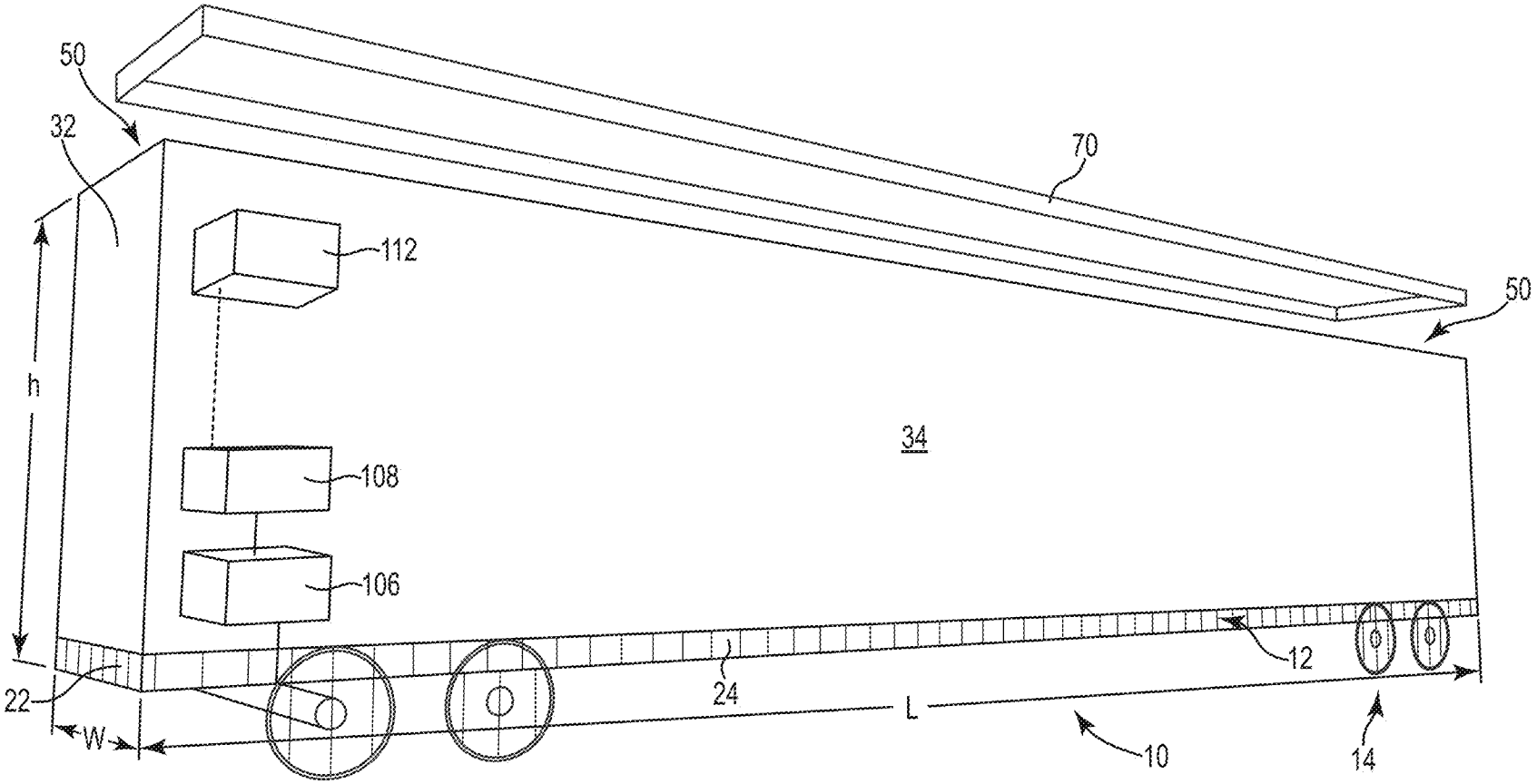

FIGS. 1B and 1C show an example of a single-piece removable roof 70 that can be lifted and lowered relative to a top of railcar 10 to allow access to railcar interior 40 through a top opening 50. Roof 70 is detachable completely from engagement with a top portion of walls 30, 32, 34, and 36 of railcar 10.

Figure 1D:
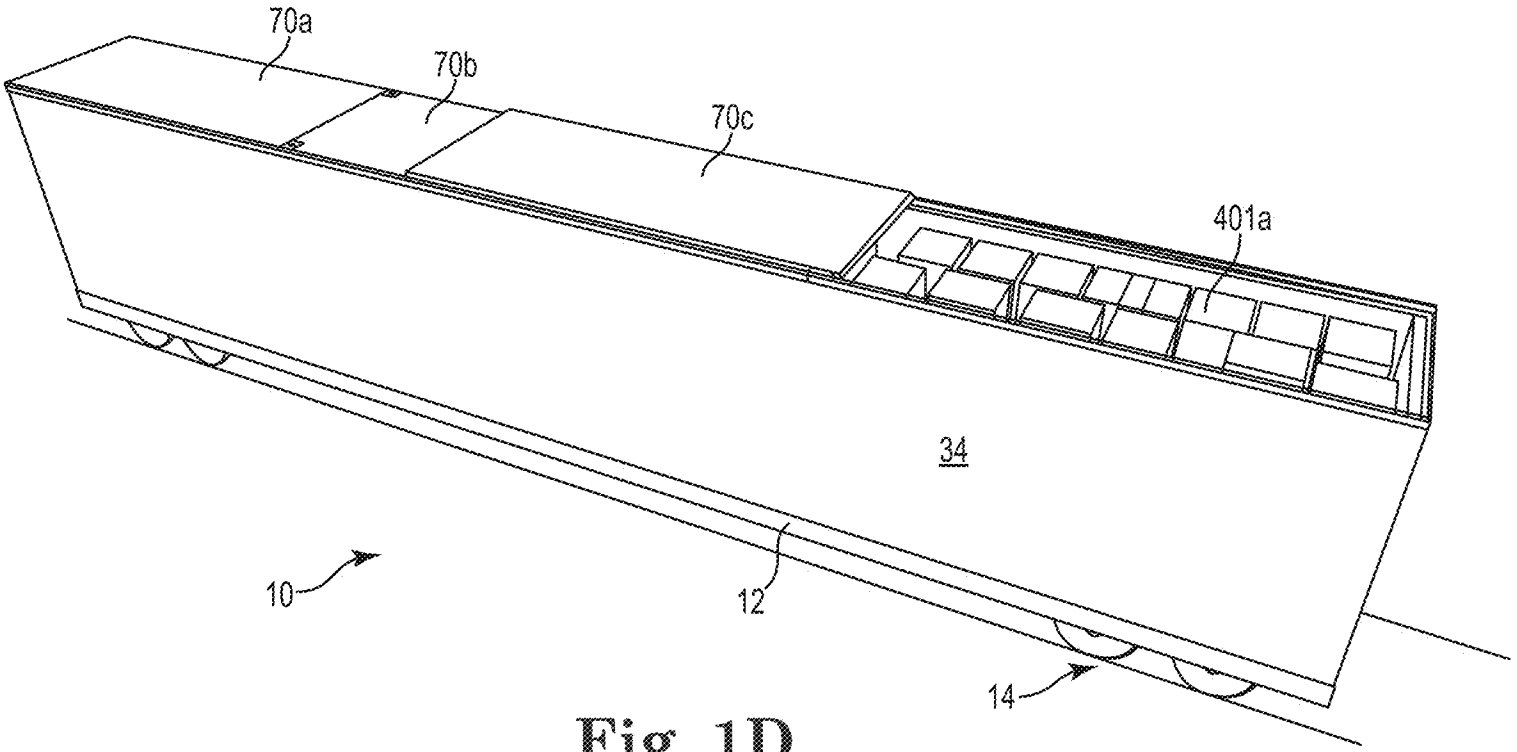

In another example, shown at FIG. 1D, a removable roof 70 includes three roof segments 70*a*, 70*b*, and 70*c*. Each roof segment can slide along a length of railcar 10, along sides 34 and 36, to open a segment (40*a*, 40*b*, or 40*c*, respectively) of railcar interior 40, for loading and unloading of removable carriers 10 through a top opening.

Figure 2B:
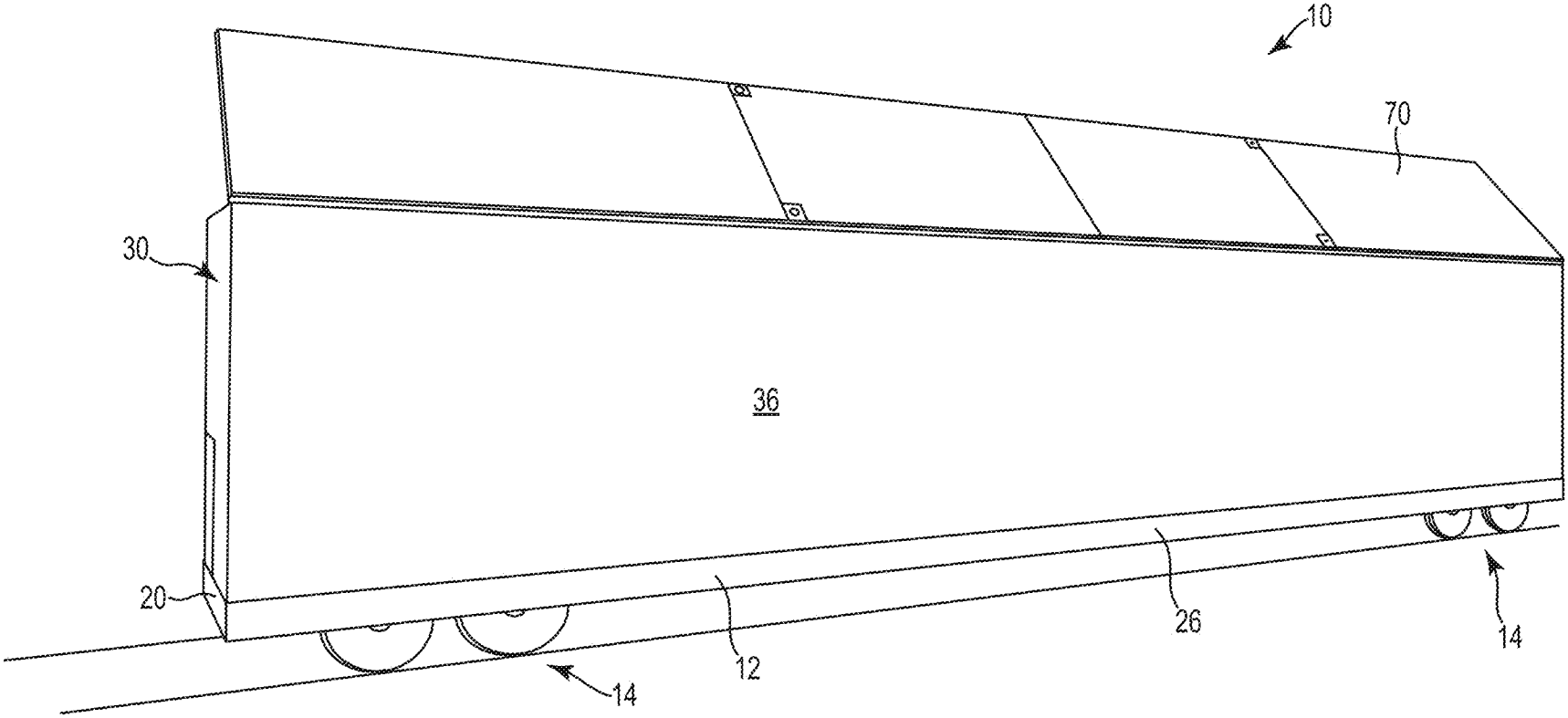
Figure 2C:
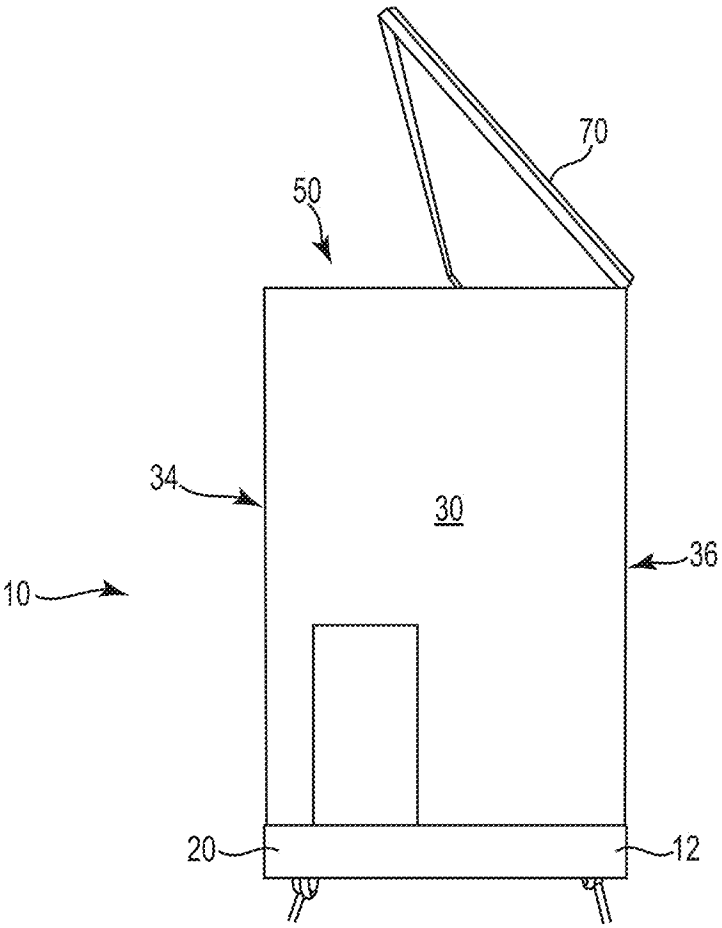

In another example, shown at FIGS. 2A, 2B, and 2C, a removable roof 70 is rotatably attached along a length of an upper side wall of vessel 10, and opens along a hinge without detaching from vessel 10. FIG. 2B shows a roof 70 of vessel 10 that may optionally include multiple length-wise segments corresponding to interiors 40*a*, 40*b*, and 40*c*. Roof 70 or segments thereof are removable from the top of vessel 10 by swinging (rotating) about the hinge that connects roof 70 to side 36 of vessel 10. The hinged attachment of roof 70 to wall 36 allows roof 70 to pivot about the length of side 36 to an opened position that exposes top opening 50 and interior 40 of vessel 10.

Referring to FIGS. 1A, 1B, 1D, and 2A, each compartment or segment (e.g., 40*a*, 40*b*, 40*c*) of a top-loading railcar can be sized to approximate and be slightly larger than a width, a length, and a height of a one or more removable cargo carriers. Each dimension (length, width, height) of the cargo carrier can be slightly less than a corresponding dimension of the railcar interior or a segment of the interior. A small space is allowed between each of four sides of a cargo carrier and each wall of the railcar interior or a separator. In example systems, a removable carrier may have one, two, or three of: a width that is less than 100 percent of a width of a railcar interior, but that is at least 80, 85, 90, or 95 percent of the width of the railcar interior; a length that is less than 100 percent of a length of a railcar interior or a segment of an interior but that is at least 80, 85, 90, or 95 percent of the length of the railcar interior or segment; and a height that is less than 100 percent of a height of a railcar interior, but that is at least 80, 85, 90, or 95 percent of the height of the railcar interior.

As an optional feature of a railcar or system of the present description, which may be used with a railcar as described, or as a feature of any other type of railcar (e.g., not designed with at top opening or adapted to contain a removable carrier), a railcar that includes a structure of any design having railway wheels and axels may contain a generator that is connected to a wheel or axel. The generator generates electricity from the moving wheel or axel of the railcar as the railcar travels along a rail, propelled by a locomotive. The generator may be used to generate electrical power that is used by a computer processor, navigation electronics, wireless or cellular communication devices, heating or air conditioning of an interior or a cargo carrier, or a combination of these.

An example is shown at FIG. 1C. The illustrated railcar 10, of any design, not necessarily having a top opening or removable roof but that includes railcar wheels supported by a bogie, includes generator 106 that is connected to the axel of one of the wheels. The generator uses motion of the wheels or axel that is transferred mechanically to the generator to generate electricity, which can be stored in a battery (not specifically shown) or used directly to power computer processors, communications systems, heating or refrigeration devices and controls, or other electronics that are also contained in railcar 10. The electronics may include a one or a collection of computer processors 108. The electricity can also power a global positioning receiver or cellular or satellite communication device 112 to detect a location of the railcar and to transmit an electromagnetic signal, e.g., to a cell phone tower or wireless server (e.g., located on a nearby railcar), to transfer data generated by the computer processor 108 between the railcar and a receiving wireless or cellular communication device, which communicates with one or more remote wireless or cellular communication devices, computer processors, etc.

The method may be useful to generate electricity using the generator to power the computer processor to generate data using programmed software, and to transmit the data remotely to a separate computer. The computer processor 108 may be programmed to perform any function, for example to perform "bitcoin mining," to perform mining or managing of other cryptocurrencies or non-fungible token (NFT) different from the bitcoin token, for processing and recording blockchain transactions, for processing artificial intelligence (A.I.), or for any other computing task. E.g., the computer may be used to perform "bitcoin mining," which is understood to refer to the process of creating new bitcoin by solving puzzles, by using a computing system (computer processor 108) equipped with specialized chips competing to solve mathematical puzzles; the mining process also confirms transactions on the cryptocurrency's network and makes the transactions trustworthy. Advantageously, the power supplied to the generator to perform these cryptocurrency functions, operation, and puzzle solving ("mining") applies only a negligible load onto the railcar axel and locomotive that is moving the railcar, and the power used to run the computer processor, e.g., for bitcoin mining, is negligible compared to the total power used to move a train that carries many railcars.

Certain preferred methods and systems of the present description include the use of a removable cargo carrier as described to contain cargo and to load the cargo into a top-loading cargo transport vessel, such as a railcar. In use, cargo, e.g., based on pallets or otherwise, can be loaded onto a cargo carrier at a location that is external to a railcar or other vessel, i.e., the cargo carrier is "pre-loaded" with cargo while the cargo carrier is located outside of the top-loading vessel. Each pre-loaded cargo carrier can be subsequently loaded into a railcar interior 40 (or an interior of a different type of vessel) or a segment 40*a*, 40*b*, or 40*c*, through top opening 50, with optional roof 70 in an opened position.

Figure 3A:
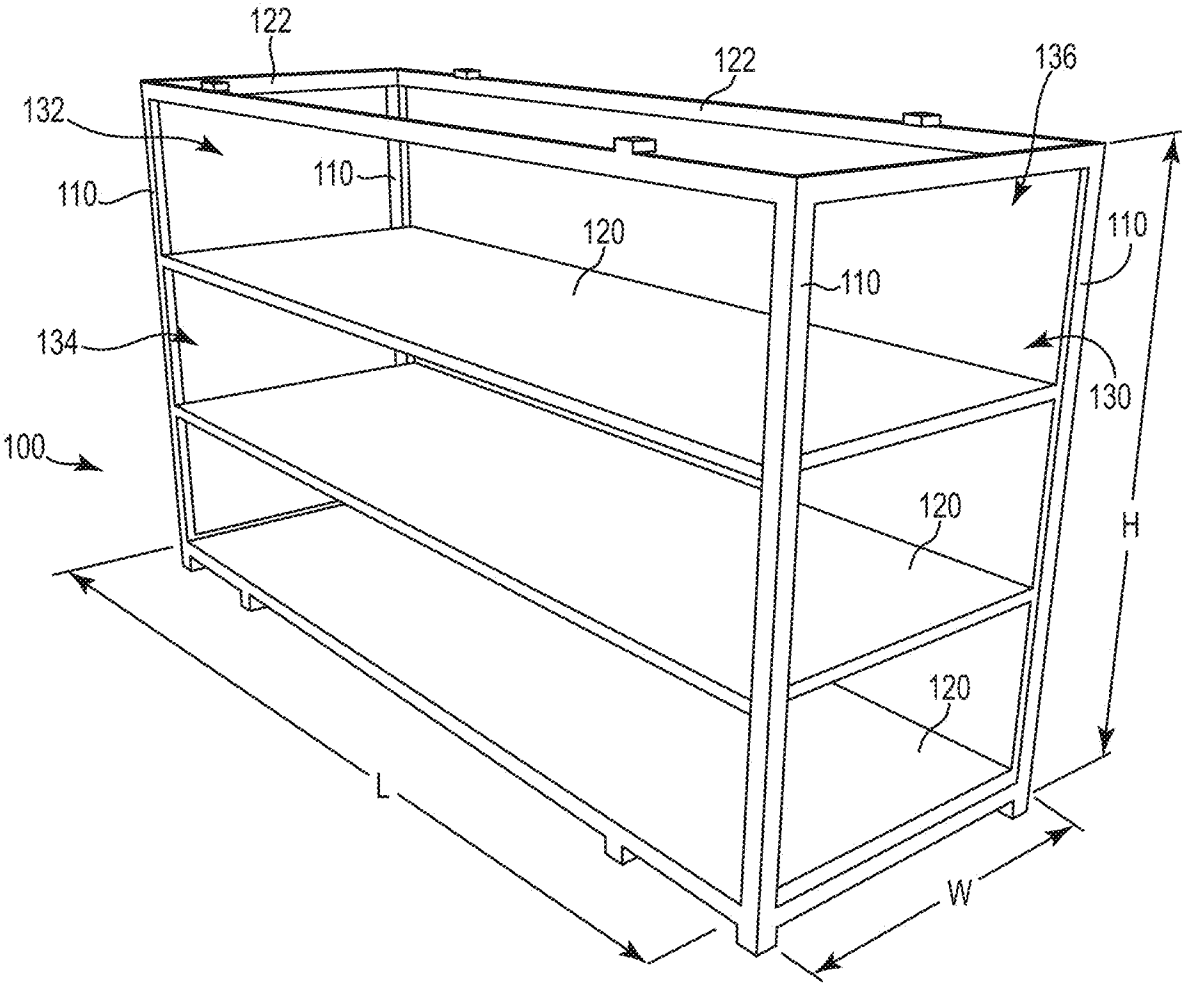
FIGS. 3A (side-perspective view), 3B (end view), and 3C (top view), show an example of a removable carrier of the present description.
Figure 3B:
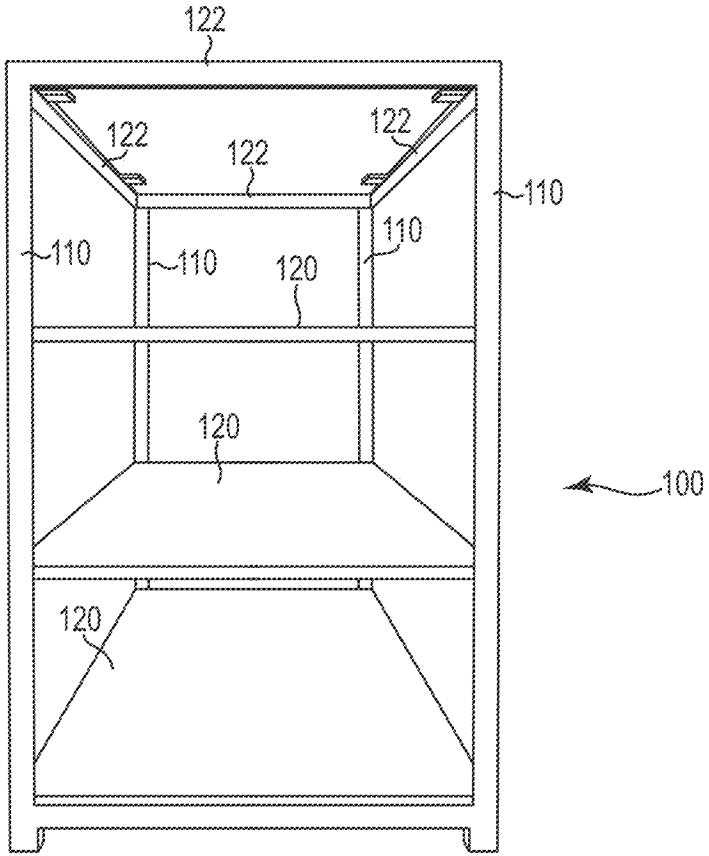
FIGS. 3D and 3E (end views) show another example of a removable carrier of the present description.
FIG. 3F shows another example of a removable carrier of the present description.
FIGS. 3G and 3H show a further example of a removable carrier of the present description.

An example of a useful removable cargo carrier 100 is illustrated at FIGS. 3A (side-perspective view), 3B (front-end view), and 3C (top view). Cargo carrier 100 includes a frame as a support structure, which includes vertical frame supports 110, horizontal top supports 122, and a horizontal bottom support surface. Vertical supports 110 engage shelves 120 at edges of the shelves and about a corner or edge perimeter of each shelf 120. Vertical supports 110 may be located at any location relative to shelves 120 to provide vertical support to shelves 120, for example at the four corners of shelves 120. Shelves 120 are supported by the frame that includes frame supports 110 and may be secured to supports 110 in a permanent fashion or in a manner that allows each shelf 110 to be moved vertically and selectively secured at different positions along the height of supports 110 for supporting cargo of different heights. According to alternate embodiments of carrier 100, shelves 120 can slide laterally through an opening between vertical supports 110 at either end of carrier 100 to be loaded onto or removed from the frame.

Figure 3C:
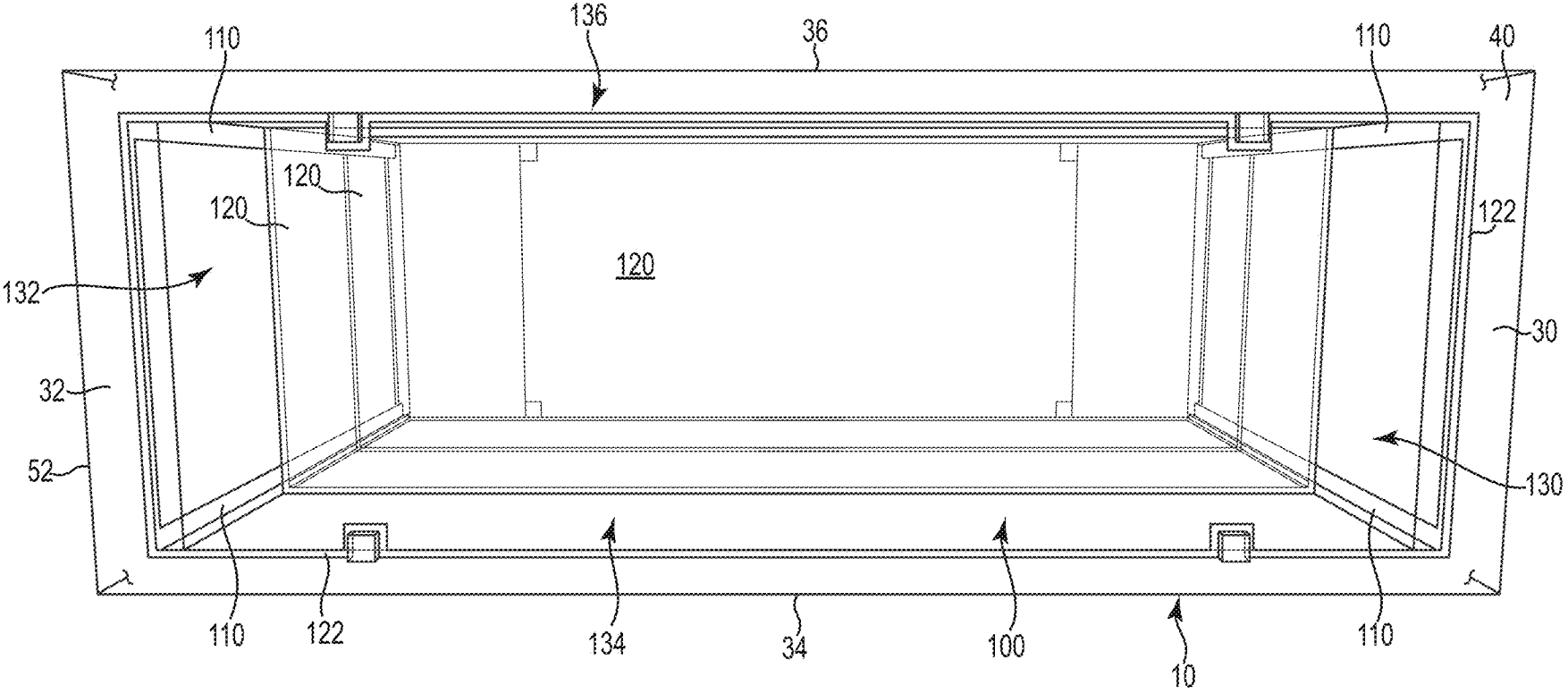
Figure 3D:
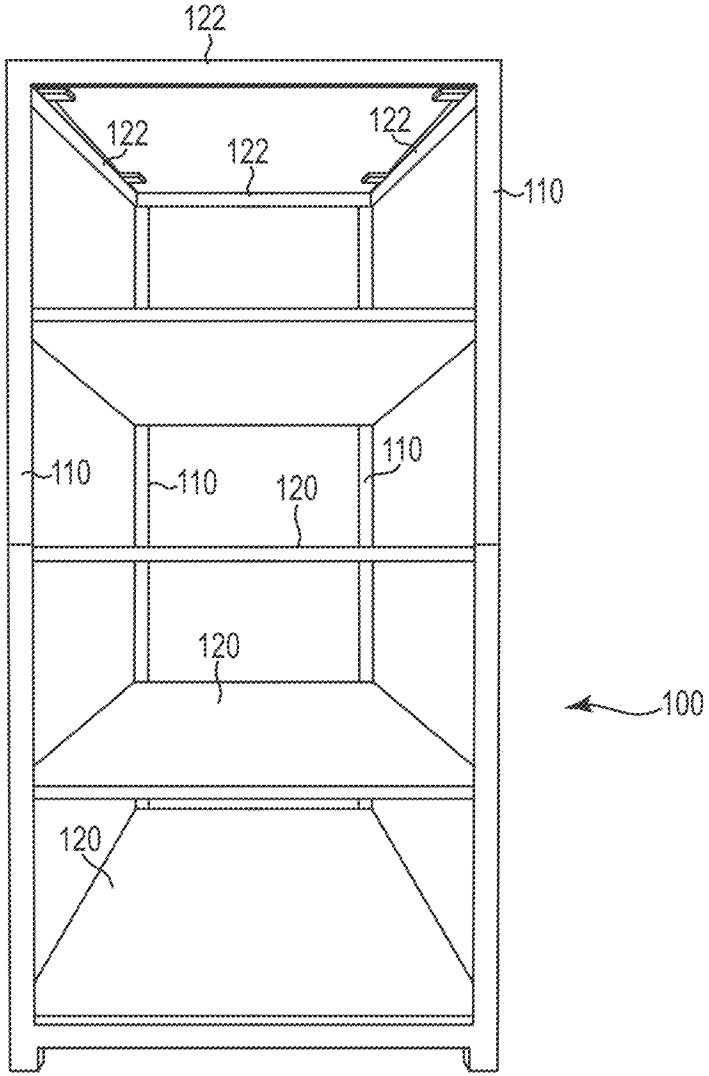
Figure 3E:
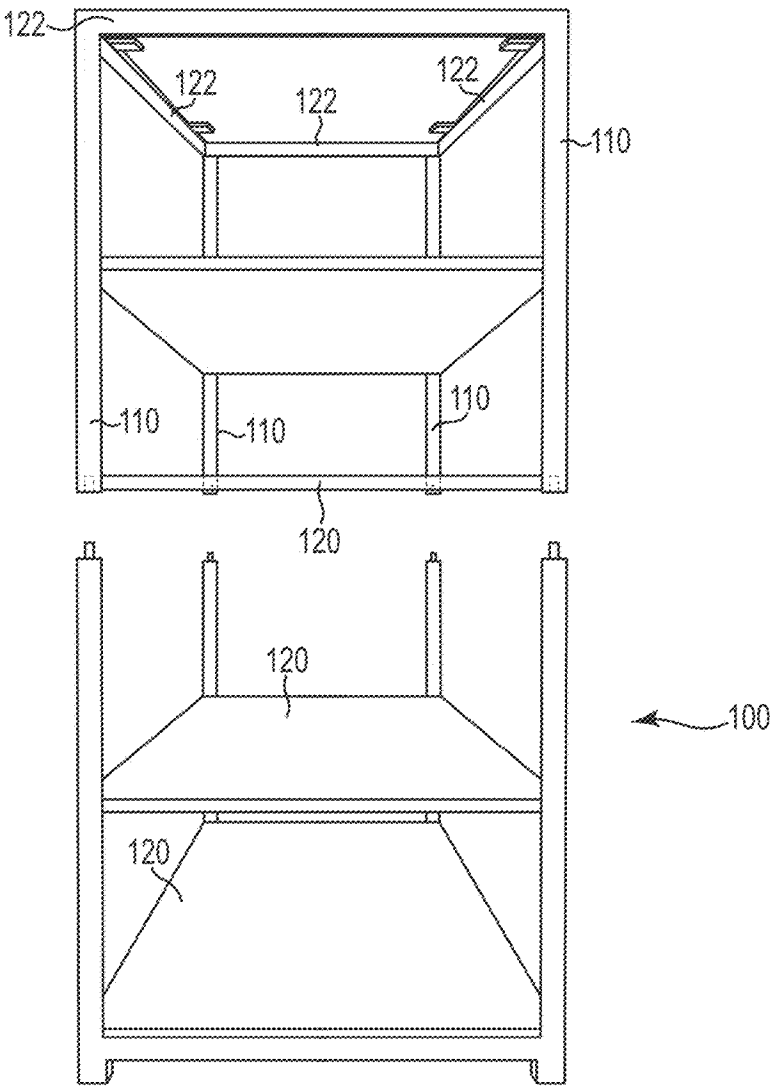

As shown at FIGS. 3D and 3E, a frame of a removable carrier may alternately be made of multiple separate pieces ("stackable carrier pieces") that support one or more shelves or bottom support. Multi-piece, stackable removable carrier 100 includes multiple separate vertical pieces, each piece having one or more horizontal shelves 120 supported by vertical frame supports 110. Cargo (not shown) can be loaded onto the shelves of each of the multiple pieces at a location separate from a top-loading vessel. Once the stackable container pieces have been loaded to contain cargo, the stackable pieces can be loaded, either individually or together, into an interior space of a top-loading vessel. As shown at FIG. 3E, a bottom piece of carrier 100 can be loaded to contain cargo, moved, and then loaded into a cargo transport vessel; an upper piece of carrier 100 can be separately located to contain cargo, and moved, then loaded into the same cargo transport vessel to sit on top of the bottom piece, engaging the bottom piece at frames 110.

Figure 3F:
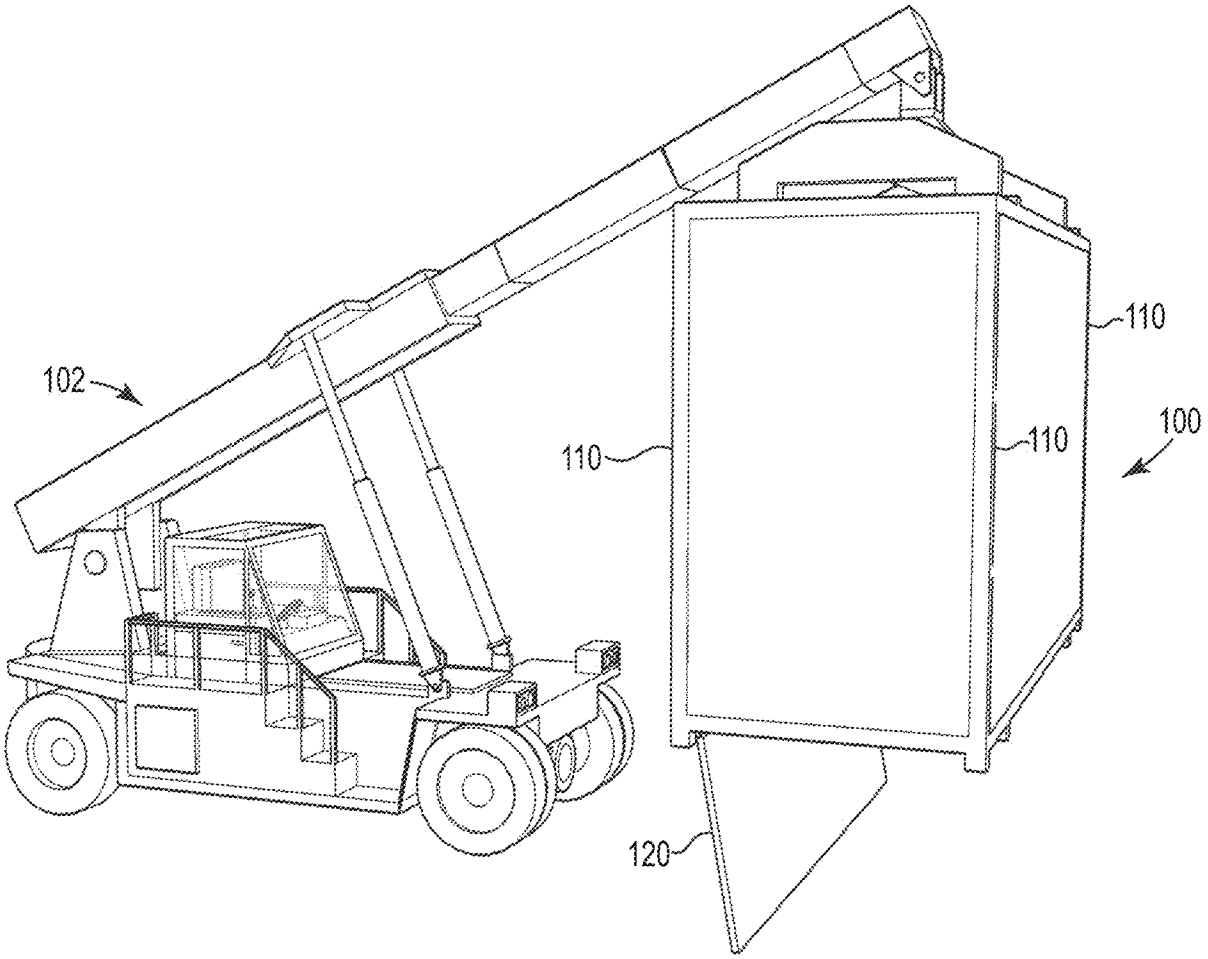
Figure 3G:
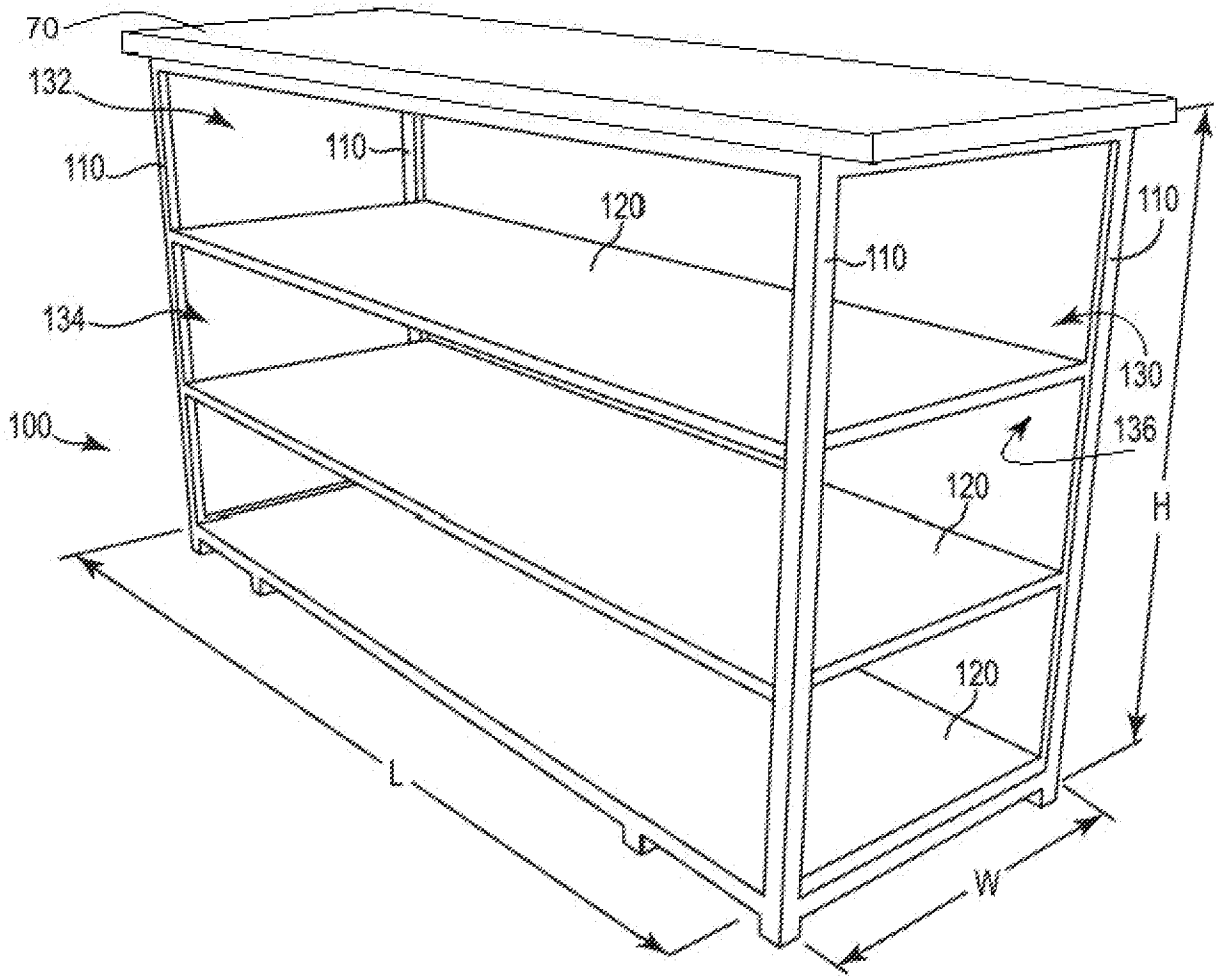
Figure 3H:
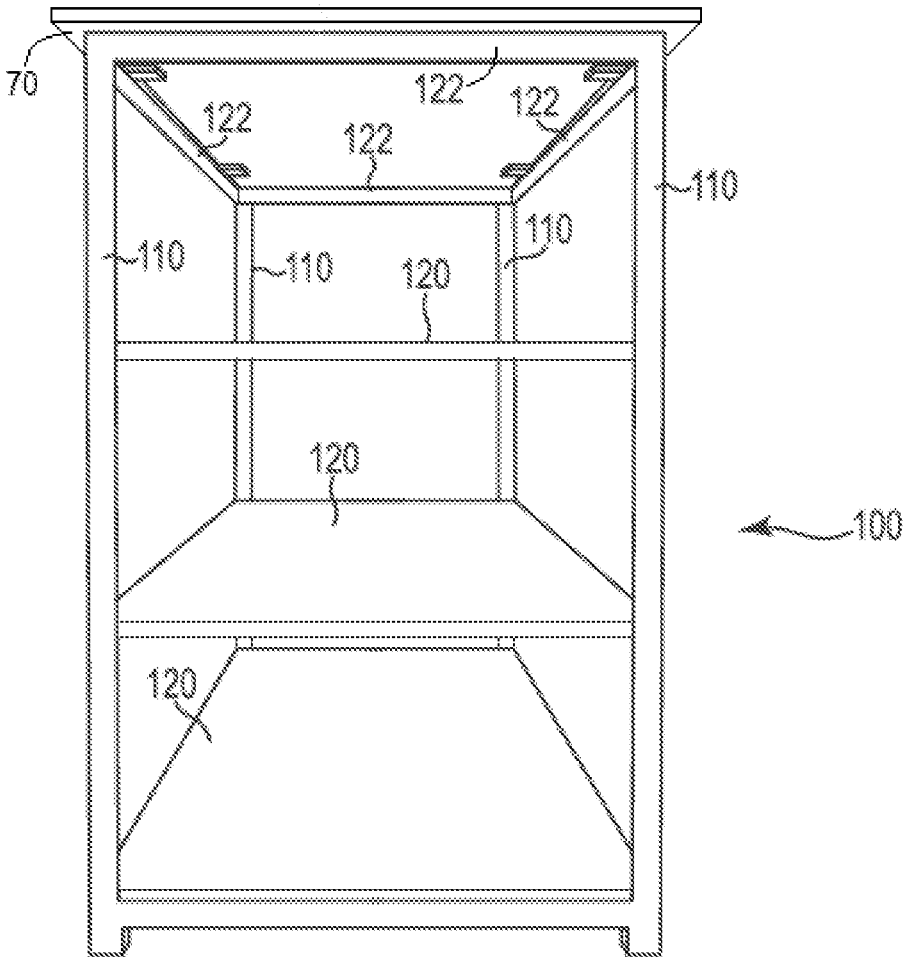

As shown at FIG. 3F, a bin carrier 100 may be constructed using vertical frame supports 110, a bottom horizontal support 120 at the bottom of the frame, and no horizontal shelves supported by the frame between the top and bottom of the vertical frame. An example of this type of "bin" includes an interior defined by four vertical sides, a top opening (with an optional removable roof or cover) that allows cargo (e.g., an aggregate material such as rocks, sand, ore, or the like) to be loaded into the carrier bin through the top opening, and a bottom (bottom horizontal support) that supports the cargo contents of the carrier and that may be opened to unload the contents from the carrier through a bottom opening.

In use, a cargo carrier 100 of any design, see FIGS. 3A through 3F, that is pre-loaded to contain cargo, can be loaded into an interior of a cargo transport vessel (illustrated as railcar 10) through top opening 50, while roof 70 is in an opened position. FIG. 3C (top view) shows cargo carrier 100 loaded in and contained in interior space 40 of railcar 10 (only the outer perimeter is shown at FIG. 3C) having front wall 30, back wall 32 (alternately separator 52), sidewall 34, and sidewall 36.

Removable carrier 100 can be considered to have four "sides," each of which has a height and a width or length, that align with a height and a width or length of the railcar. The four sides include a front side 130, a rear side 132, and two opposed length sides 134 and 136. The front side 130 faces a front wall 30 or a separator 52 of the cargo transport vessel when contained in the vessel. The rear side 132 faces a rear wall 32 or a separator 52 of the vessel when contained in the vessel. And the two length sides 134 and 136 each face a sidewall 34 or 36, respectively, of the vessel when contained in the vessel.

The system of a top-loading cargo transport vessel used in combination with one or more removable cargo carriers is useful for efficiently loading a removable carrier that is pre-loaded with pieces of cargo into an interior space or spaces of a cargo transport vessel through a top opening of the vessel, transporting cargo that is loaded onto a cargo carrier or cargo carriers in the vessel, then efficiently unloading the removable cargo carriers from the vessel at a destination. The use of top-loading cargo vessels with removable cargo carriers allows for highly-efficient, high-density packing of the interior space of the vessels, as well as efficient and rapid loading and unloading operations of the top-loading vessels and, with vessels in the form of railcars, efficient and rapid loading and unloading of a train that contains the top-loading railcars.

In addition, the removable cargo carriers function to secure cargo during shipment, minimizing load damage, and provide means for stacking cargo efficiently without damage. In an exemplary embodiment, a cargo carrier is configured to efficiently support multiple pallets having dimensions of 40"×48"×54" or smaller; pallets of other dimensions may also be carried by a removable cargo carrier, as well as cargo that is not based on a pallet. The pallets may preferably be stacked on multiple shelves of the removable cargo carrier with one layer of pallets per shelf, and with shelves that are located at heights of the cargo carrier to accommodate pallets having cargo of different height ranges on different shelves. A removable cargo carrier may be configured to address specific needs of a user (e.g., a cargo shipper or cargo owner) and to fit a specific type of cargo transport vessel (e.g., railcar, intermodal container, etc.) selected for shipment, or to be otherwise transportable by a truck or airplane.

One example of a removable carrier may be sized for use in a top-loading railcar. A version of a standard boxcar can have an interior length in a range from 50 to 90 feet, e.g., from 80 to 90 feet, an interior width in a range from 8 to 11 feet (e.g., from 9 to 10 feet), and an interior height in a range from 15 to 25 feet. Example removable cargo carriers can be dimensioned to fit three removable cargo carriers into a top-loading railcar as described, having a nominal length of a standard boxcar, e.g., length of 86 feet (e.g., an exterior length in a range from 80 to 90 feet), with the top-loading railcar optionally containing dividers to separate the total length of the interior into three length-wise interior segments. An example removable cargo carrier may have a length of approximately 15, 20, or 28 feet (e.g., from 10 to 30 or from 27 to 29 feet), a height of approximately 16 feet, e.g., 16 feet 6 inches (e.g., from 15 to 18 or from 16 to 17 feet), and a width of approximately 9 feet, e.g., 9 feet 2 inches (e.g., from 8 to 10 feet or from 8.5 to 9.5 feet). (As used herein, the term "approximately" allows for a dimension that is within 10 percent of the specified value.) See FIG. 4. For railcars of other nominal sizes, e.g., nominal sizes of 50 foot, 60 foot, 50 foot high cube, or 60 foot high cube, the length of the removable cargo carriers can be adjusted to allow one or two or three removable cargo carriers to fit within a total length of a segmented or un-segmented railcar.

Another example of a removable carrier may be sized for use in a top-loading intermodal container. Standard intermodal containers have a door opening that is 7 feet 8 inches wide and interior dimensions of: a width of 7 feet 8 inches, a height of 7 feet 10 inches or 8 feet 10 inches (for a "cube" container); and a length of 9 feet 3 inches (a 10-foot container), 19 feet 3 inches (a 20-foot container or 20-foot high cube), or 39 feet 5 inches (a 40-foot container or 40-foot high cube). An example removable cargo carrier for use in an intermodal container may have a length that is from 1 to 5 feet less than the length of the container, a height that is from 1 to 5 feet less than the height of the container, and a width that is from 1 to 5 feet less than the width of the container.

For use with any example of a top-loading railcar or intermodal carrier, a removable carrier may be a single-piece carrier, a multi-piece, stackable carrier, or a bin carrier, as illustrated at any of FIGS. 3A through 3F.

Figure 4:
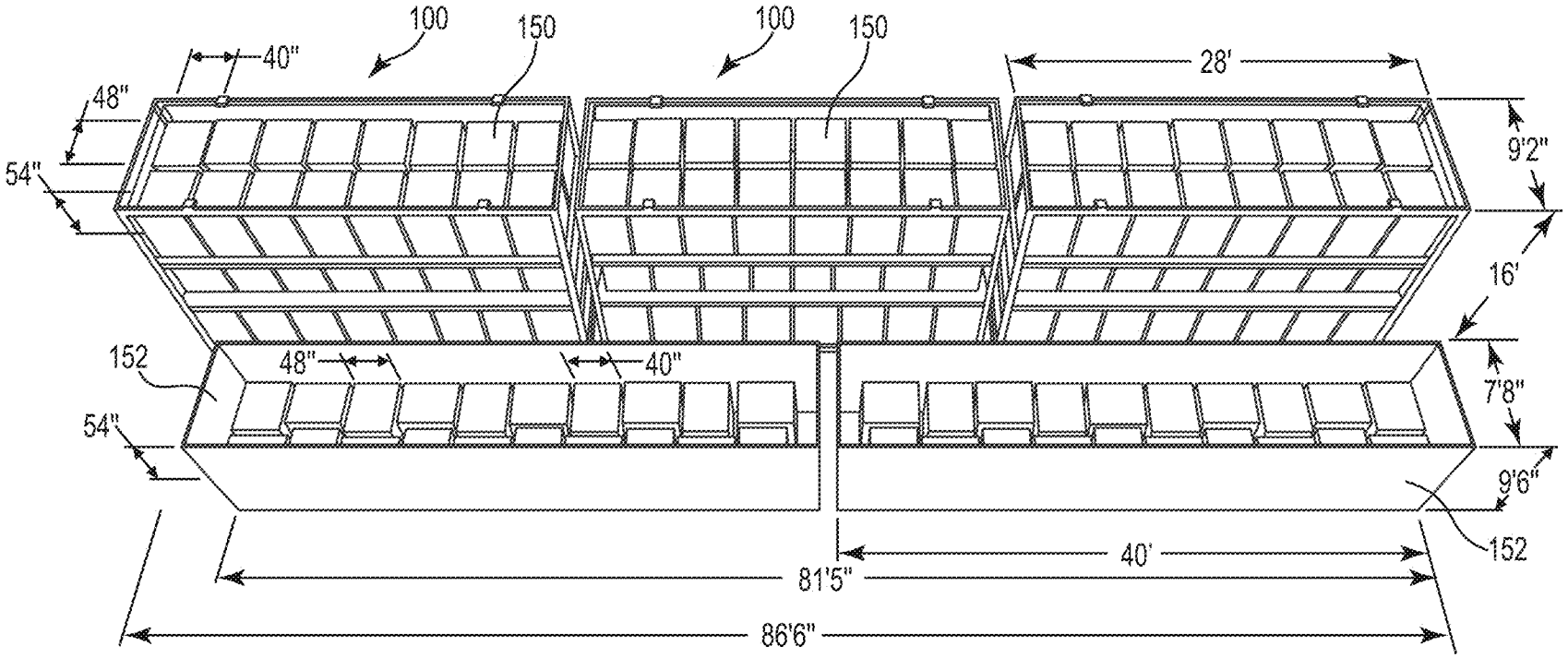
FIG. 4 (top-perspective view) shows an example of removable carriers loaded with cargo for comparison to intermodal cargo containers loaded with cargo, without the use of removable cargo carriers.

As shown at FIG. 4, three example removable cargo carriers 100 are pre-loaded with cargo in the form of pallets 150. Each cargo carrier 100 has three shelves to allow for three horizontal levels of support for cargo. Each cargo carrier has a useful width of approximately 9 feet and 2 inches, i.e., 110 inches, and can accommodate two pallets, side-by-side along the width, with both pallets having a maximum length or width dimension that may be greater than 40, 44, 46, 48, 50, or 52 inches, and less than approximately 55 inches.

For comparison, FIG. 4 also shows two standard intermodal cargo containers ("intermodal shipping containers," "intermodal containers," or the like) of the type commonly used as intermodal transport vessels to contain, store, or transport cargo. The intermodal cargo container is of an intermodal design that is designed for the container to be carrier and transferred without unloading contents by any combination of ship, train, and truck. A standard cargo container is an enclosed metal container with doors at an end to allow loading and unloading through the doors. Standard containers have a door opening that is 7 feet 8 inches wide and interior dimensions of: a width of 7 feet 8 inches, a height of 7 feet 10 inches or 8 feet 10 inches (for a "cube" container); and a length of 9 feet 3 inches (a 10-foot container), 19 feet 3 inches (a 20-foot container or 20-foot high cube), or 39 feet 5 inches (a 40-foot container or 40-foot high cube).

Referring to FIG. 4, illustrated for comparison are three removable carriers 100 as described, and two 40-foot intermodal containers 152 (note that the intermodal containers are a top view and are illustrated without the roof panel on top of the container). Both the removable carriers and the 40-foot intermodal containers can be loaded together end-to-end on a single standard flatbed railcar. As shown, across the 9'2" (100 inch) width of carriers 100, each shelf of a carrier 100 can contain eight pairs of two pallets placed side-by-side with the 48-inch dimensions extending in the width direction of carrier 100. Each shelf can contain 16 pallets (40×48×54). Each three-shelf carrier can contain 48 pallets. And each three-segment railcar can contain 144 pallets.

As is also shown, the width of 7 feet 8 inches, i.e., 92 inches, of intermodal containers 152 is constraining with respect to loading standard pallets having dimensions of 40" by 48". The 92 inch width and the 40 foot length of intermodal containers 152 allows a significantly lower total number of the same 40" by 48" pallets to be arranged on one horizontal level of the container 152. And depending on the cargo, pallets may be difficult to stack vertically, which prevents more than one horizontal level of pallets from being loaded into a cargo container that does not contain multiple horizontal support layers ("floors" or "shelves"). The two containers 152, each having only one single horizontal loading space, can contain only a fraction of the total number of pallets that can be loaded into the three removable carriers 100, having larger length and width dimensions and three (as illustrated) shelves.

Figure 5A:
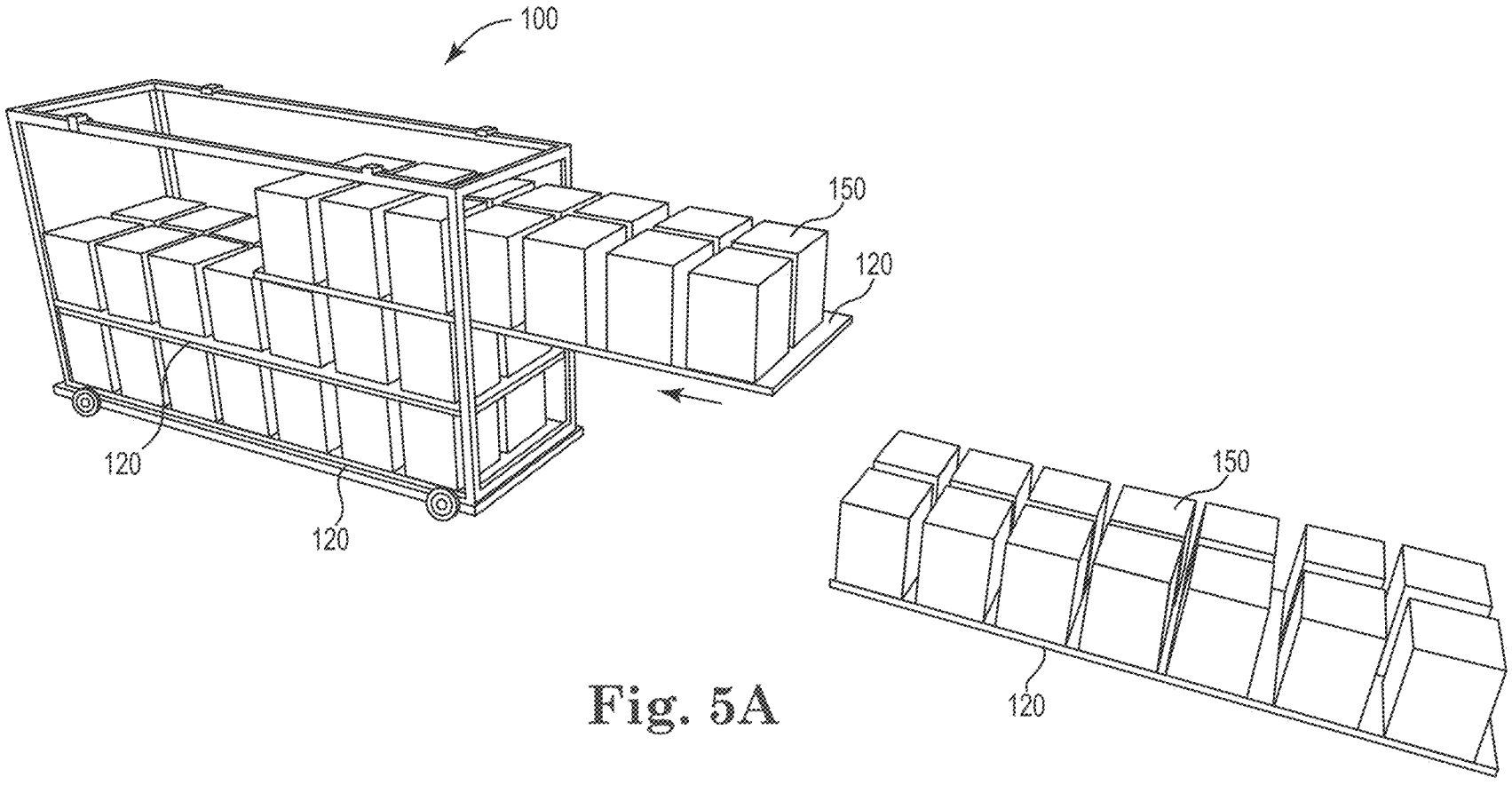
FIGS. 5A, 5B, 5C, 5D, 5E, 5F, and 5G show examples of methods of loading a removable carrier of the description.

Cargo pieces, particularly in the form of pallets 150 (or another form), can be loaded onto a removable cargo carrier by any useful method to pre-load the cargo carrier for subsequent loading into a top-loading cargo transport vessel, such as a railcar. As illustrated at FIG. 5A, shelves 120 of a removable cargo carrier 100 can be movable and removable relative to vertical frame supports 110. A shelf may be loaded away from the cargo carrier and loaded from an end or a side of the cargo carrier 100 by sliding the cargo carrier horizontally to place the shelf in a location of the shelf being supported vertically by vertical frame supports 110 of the cargo carrier 100.

According to particular methods, to achieve increased loading density of a removable carrier, pieces of cargo that all have a height within a first height range can be loaded onto a common shelf of a carrier, and cargo in a second (different) height range can be loaded onto a different common shelf. In other words, cargo pieces can be organized and selected based on height, with cargo pieces of similar heights or within a narrow range of heights being placed on a common shelf; the shelves, loaded with cargo pieces having heights within a selected range, can be placed at vertical positions along a height of a frame of a carrier to reduce distances between the tops of cargo pieces on one shelf and a bottom of a shelf located above each cargo piece. See FIGS. 5E, 5F, and 5G.

Figure 5B:
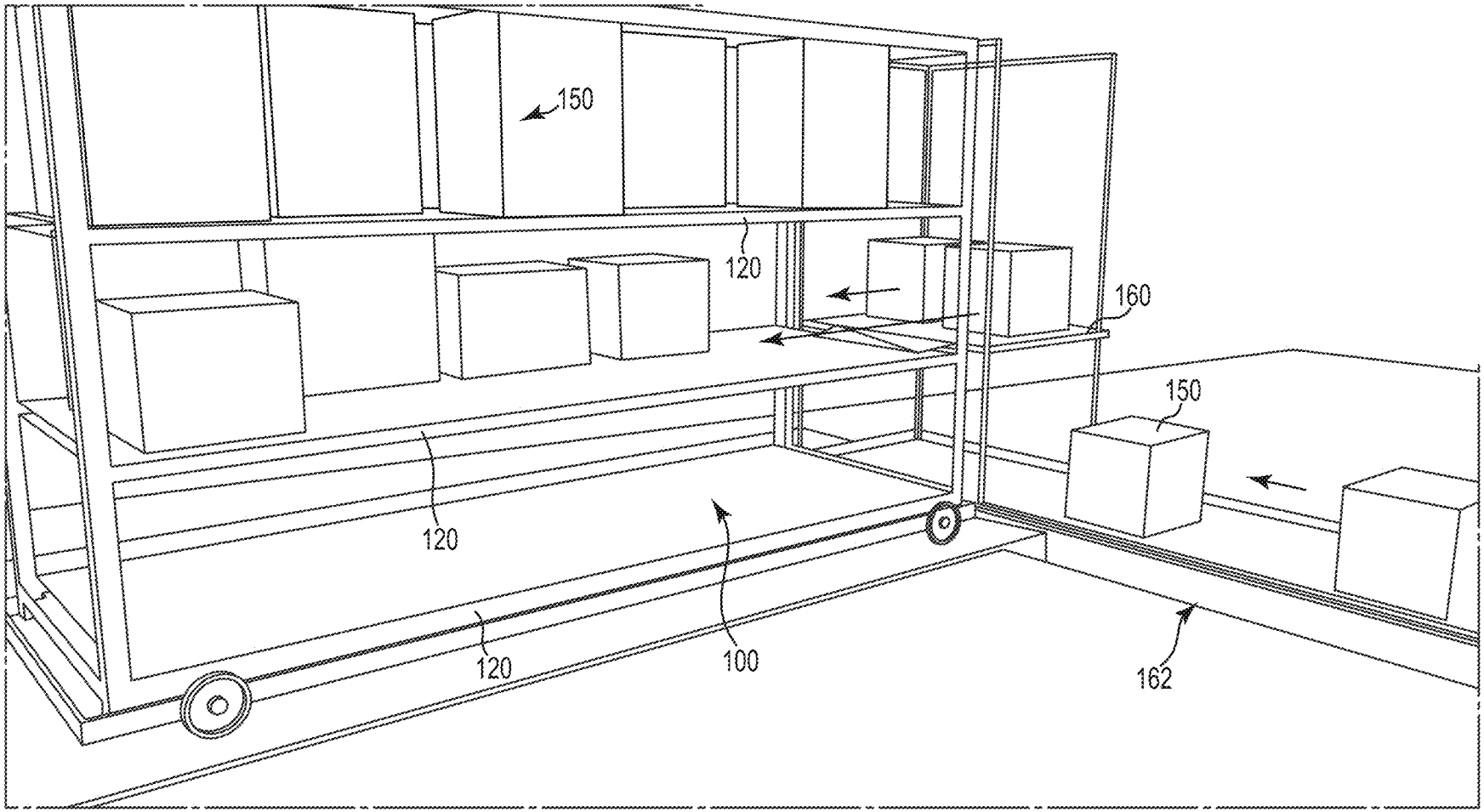

In other example carriers, as shown at FIG. 5B, a conveyor 162 may move cargo pieces 150 in a direction toward an end of a removable cargo carrier 100 to an elevator 160. The elevator may raise the cargo pieces and the cargo pieces may be loaded from the end, at the elevator, at a height of a shelf 120. Optionally, the elevator may instead be located along a length of carrier 100 and the cargo pieces may be loaded from the side along the length.

Figure 5C:
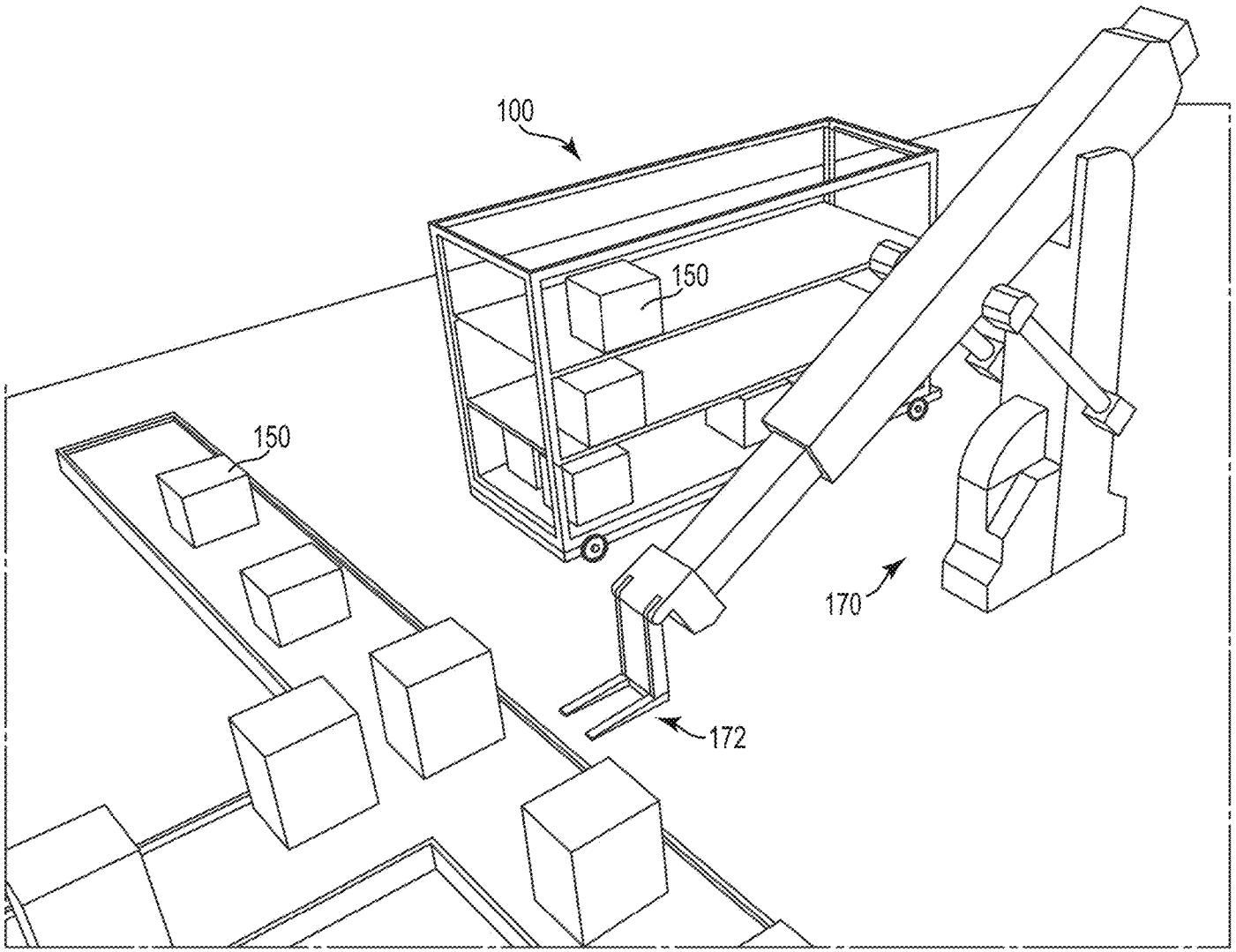

FIG. 5C shows an automated system that uses robot 170 to load cargo pieces 150 onto cargo carriers 100. Robot 170 includes a robot arm having a forklift end 170, which can hold and move each pallet 150 in an automated fashion onto shelves 120 of various cargo carriers 100. Robot 170 can be controlled to match individually-identified pallets 150, each having an inventory designation, with individually-identified cargo carriers 100, to maintain inventory control over each cargo piece (e.g., pallet) 150.

Figure 5D:
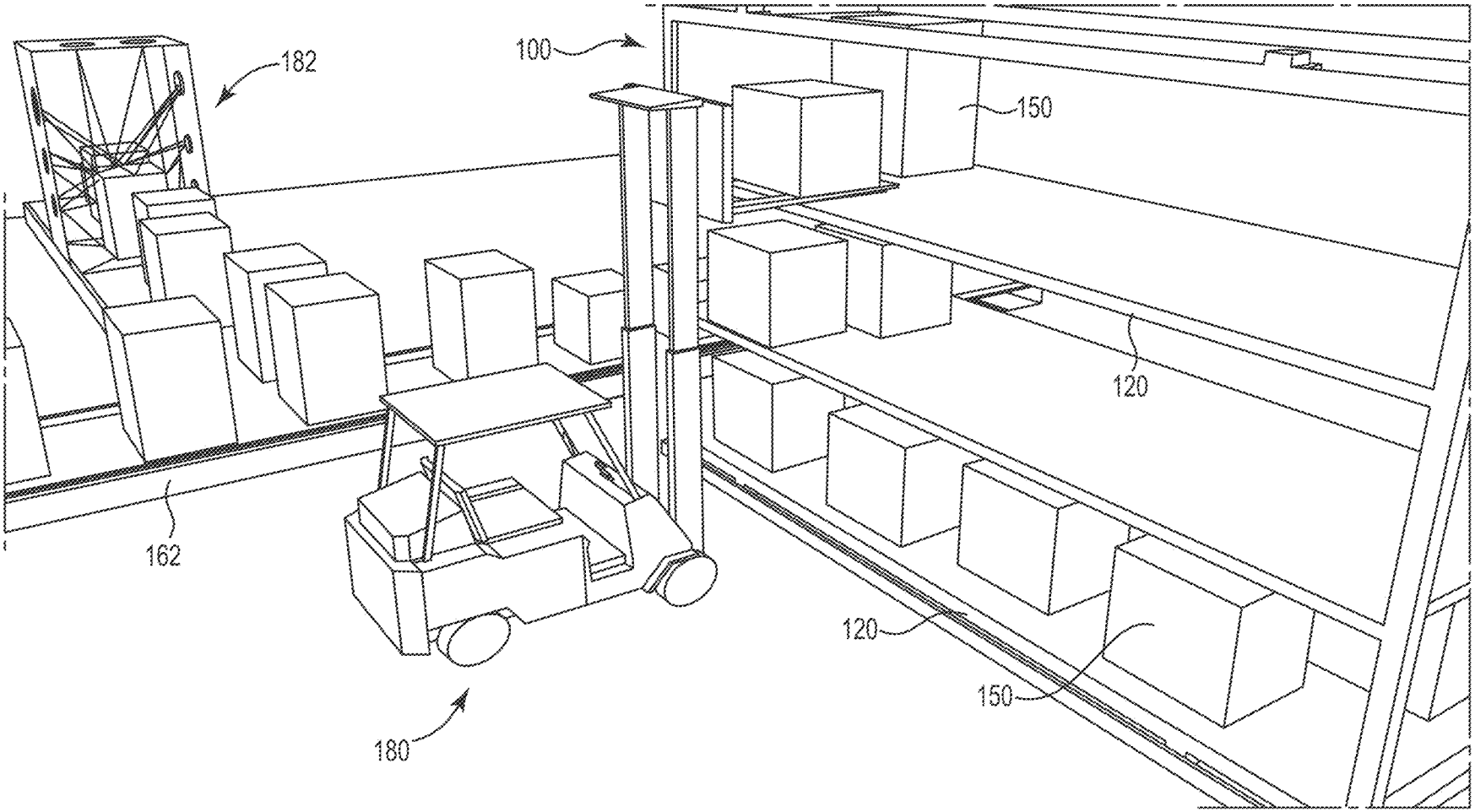

FIG. 5D shows an example of a system that uses inventory tracker 182 and forklift 180 to load and track cargo pieces 150 onto removable cargo carriers 100. Inventory tracker 182 includes an electronic, automated system of identifying individual cargo pieces 150 as each piece passes through tracker 182. The system may include a scanner (e.g., a laser scanner) to read a barcode or similar individual package designation. Alternately, the system may include a radio frequency identification (RFID) scanner (to detect RFID tags attached to cargo pieces 150) that scans individual cargo pieces 150 and records a location of each piece 150 for a purpose of inventory tracking and location tracking during transport of the piece 150.

Figure 5E:
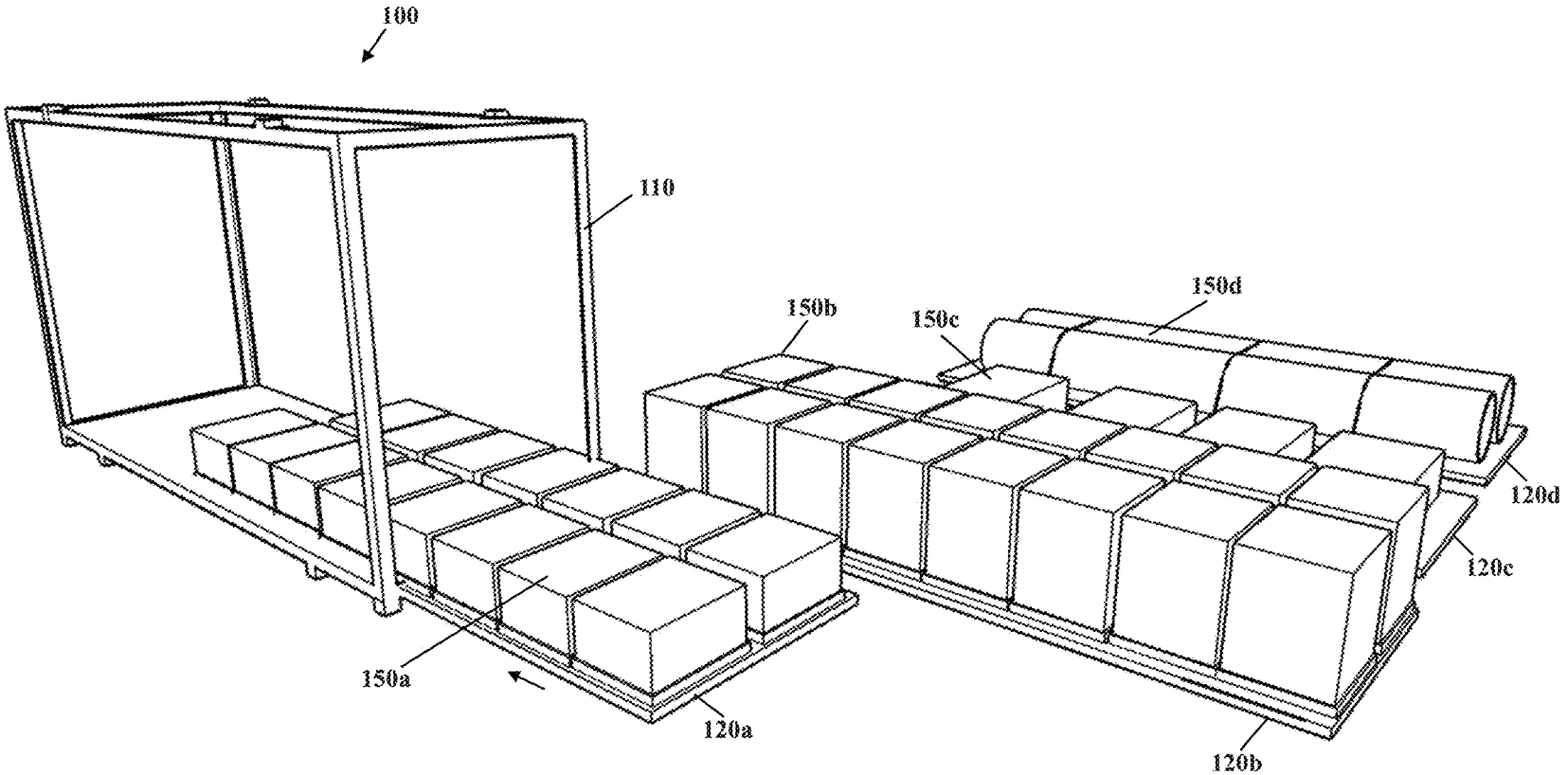
Figure 5F:
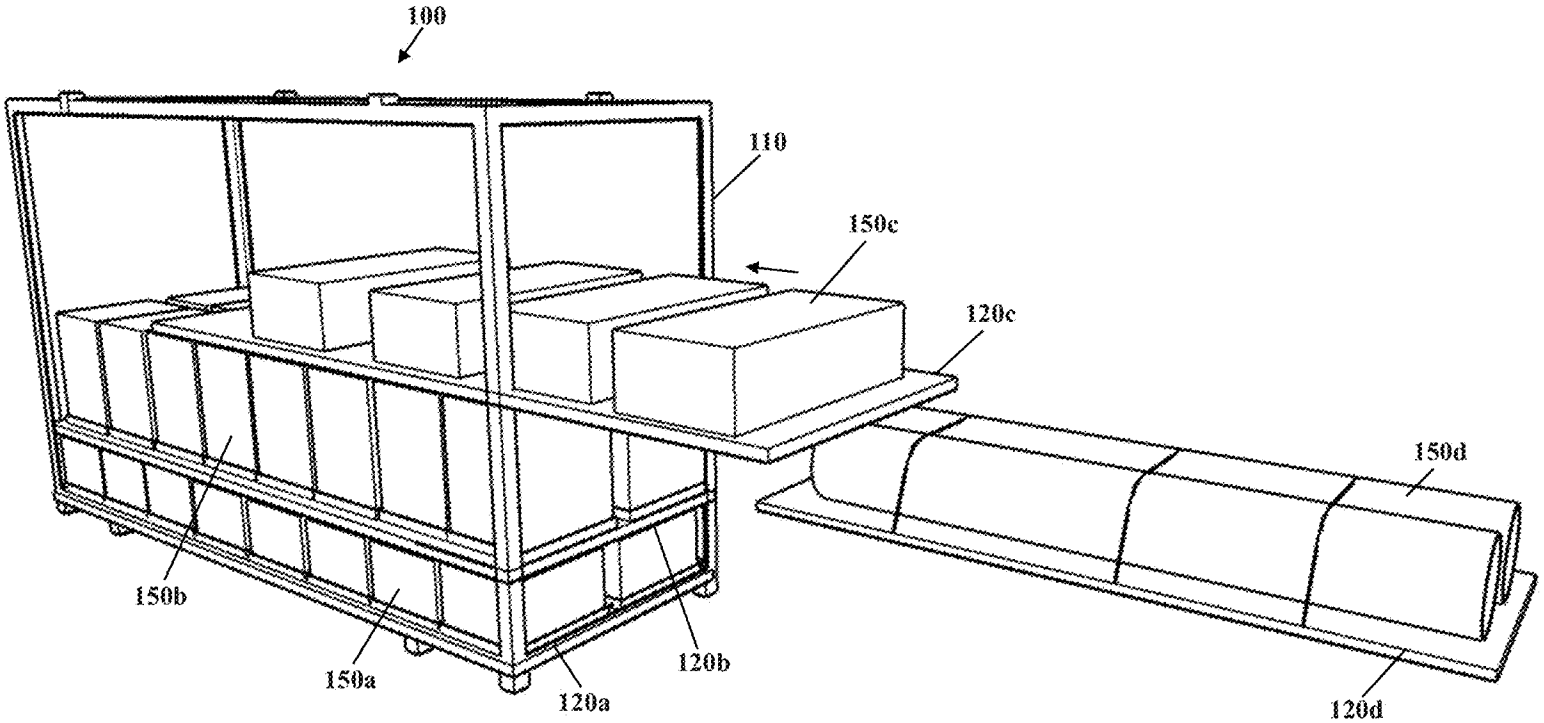
Figure 5G:
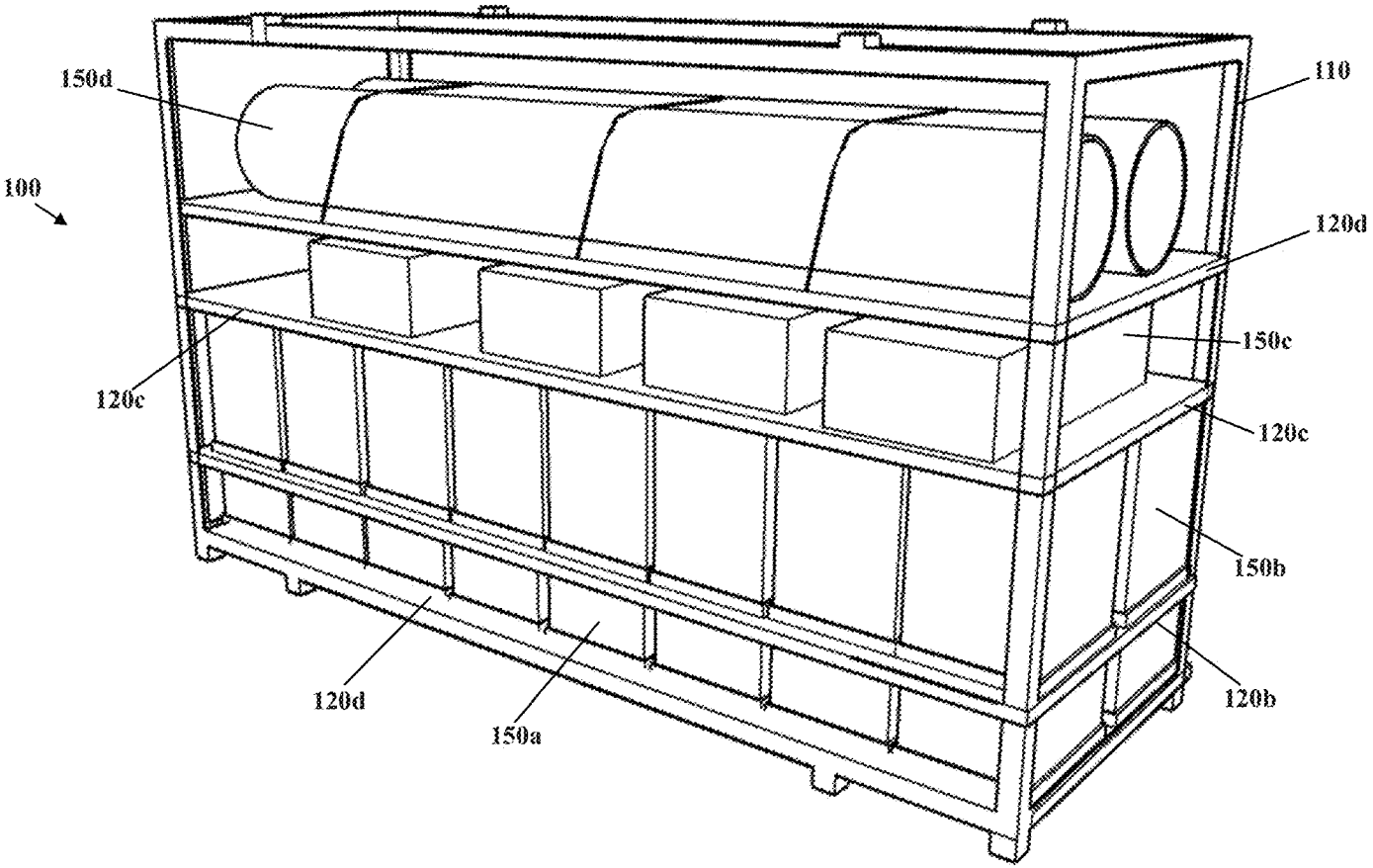

According to any method of loading a carrier, cargo pieces can be arranged to have pieces of similar heights on a common shelf, and cargo pieces of heavier weights can be placed on lower shelves. Referring to FIGS. 5E, 5F, and 5G, carrier 100 includes shelves 120*a*, 120*b*, 120*c*, and 120*d* supporting cargo pieces 150*a*, 150*b*, 150*c*, and 150*d*. When loading cargo pieces onto the shelves, the heaviest cargo pieces, 150*a*, can be placed on the lowest shelf, 120*a*. The lightest cargo pieces, 150*d*, can be placed on the highest shelf, 120*d*. Cargo pieces of weights between the lightest and heaviest, pieces 150*b* and 150*c*, can be placed on intermediate shelves 120*b* and 120*c*, with heavier pieces 150*b* on lower intermediate shelf 120*b* and lighter pieces 150*c* on higher intermediate shelf 120*c*. Also as illustrated, cargo pieces with similar heights are placed on a common shelf; e.g., the heights of all cargo pieces on a shelf may be selected to not vary by more than 20 percent, e.g., 10 percent, from (greater than or less than) an average height of all cargo pieces on the shelf.

Carrier 100 of FIGS. 5E, 5F, and 5G is of a type having removable shelves 120, which can be removed from frame 110 of carrier 100 and loaded with cargo pieces 150 while the shelf is separated from rack 110. See FIG. 5E. As shown in FIGS. 5E and 5F, each shelf, with cargo supported on the shelf, can be slid into frame 110. FIG. 5G shows carrier 100 pre-loaded with cargo supported on all four shelves, and ready to be loaded into a top-loading cargo transport vessel (of any form, not shown).

Once a removable cargo carrier has been pre-loaded with cargo pieces 150, each cargo carrier can be staged at a location from which the carrier can be loaded vertically into an interior of a top-loading cargo transport vessel, e.g., a top-loading railcar or other top-loading vessel.

The following example illustrates and describes a system of the invention in terms of cargo transport vessels that are top-loading railcars that are part of an assembled freight train. It will be understood that the methods and systems described in terms of this example may also be useful for systems of loading and un-loading pre-loaded removable cargo carriers into and from any other type of top-loading cargo vessel, such as a top-loading autonomous cargo vessel or a top-loading intermodal container.

Figure 6A:
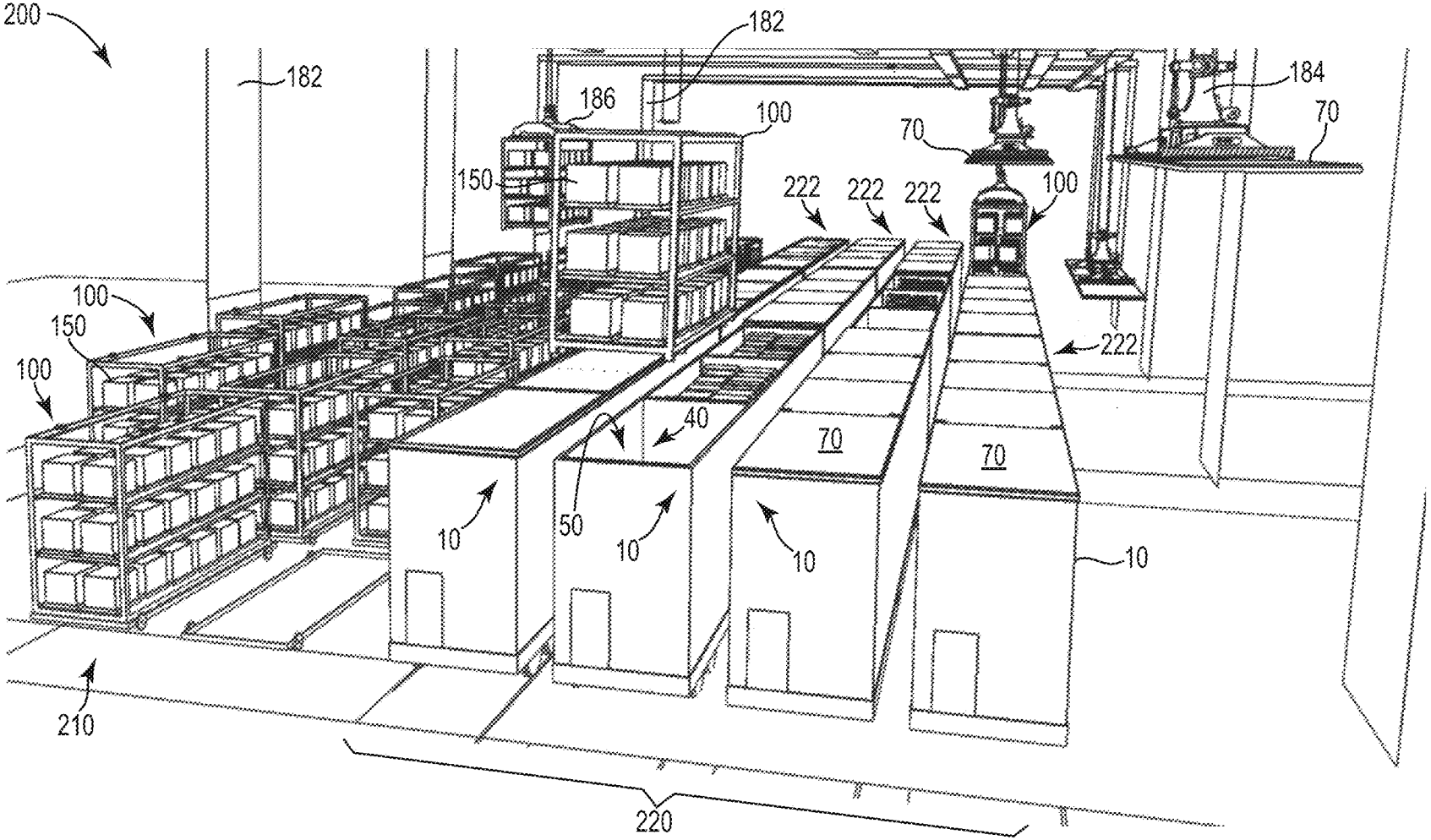
FIGS. 6A and 6B show an example of a method of loading and un-loading removable carriers to and from top-loading cargo vessels of the description.
Figure 6B:
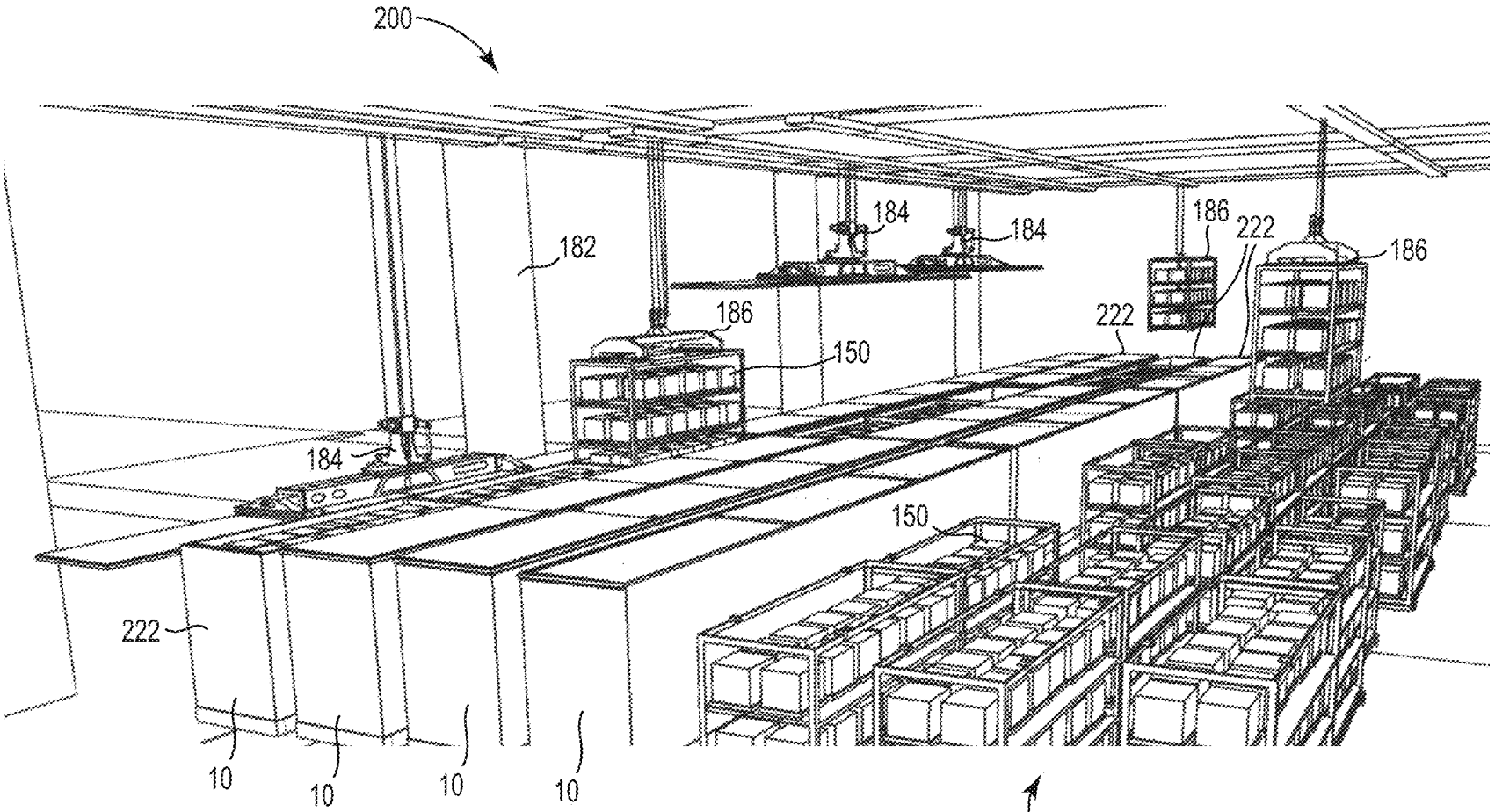

Referring to FIGS. 6A and 6B, illustrated are two perspective views of a train loading station 200. Station 200 includes a cargo carrier staging area 210, train area 220 that contains multiple (four as illustrated) rail lines 220, in parallel, upon each of which is positioned train 222 that includes top-loading railcars 10. Each train 222 also includes, though not illustrated, additional cars and at least one locomotive to drive the train.

Station 200 also includes crane (e.g., a gantry crane as illustrated) 182 having one or more roof-moving arms 184 and one or more carrier-moving arms 186. Each of the one or more roof-moving arms 184 is adapted to mechanically engage and lift a roof 70 from a top-loading railcar 10 and maintain a position of roof 70 away from railcar 10 as railcar 10 is loaded with pre-loaded carriers 100 through a top opening 50. Each of the one or more carrier-moving arms 186 is adapted to mechanically engage and lift a pre-loaded carrier 100 from staging area 210 and carry the carrier to a location above a railcar 10 then vertically load the carrier through a top opening of a top-loading railcar and into an interior of a top-loading railcar. After loading, the roof 70 can be replaced on the railcar 10 to enclose and secure the interior space of the railcar.

The station 200 can also include a location for staging carriers 100 that have been removed from, i.e., un-loaded from, railcars 10 of train 222, prior to loading a different pre-loaded carrier 10.

According to example steps, a train 222 that carries top-loading railcars 10 enters station 200 and aligns the railcars 10 with one or more other railcars at a location of a crane 182 that allows the crane to load and un-load the railcars through an opened roof. Multiple pre-loaded carriers 100 are staged at staging area 210 for loading onto each train 222, with inventory and tracking control of the cargo pieces.

A roof-moving arm 184 engages removable roof 70 of a top-loading railcar 10 and positions roof 70 away from railcar 10 to allow access to top opening 50 and interior 40 of the railcar. If railcar 10 is loaded with cargo, e.g., removable carriers 100, a carrier-moving arm 186 engages a carrier that is contained in the railcar, through the top opening 50. The carrier-moving arm securely grasps carrier 100 and lifts carrier 100 vertically out of the interior 40 of railcar 10, through top opening 50, and then places the de-trained carrier at a staging area for de-trained loaded carriers.

Subsequently, a carrier-moving arm 186 securely grasps another carrier 100, this one being a pre-loaded carrier 10 from staging area 210, and lifts the pre-loaded carrier 100 vertically above the interior 40 of railcar 10 and lowers the pre-loaded carrier through top opening 50 into interior 40. Roof-moving arm 184 engages re-places removable roof 70 over top opening 50 of a top-loading railcar 10.

Figure 7A:
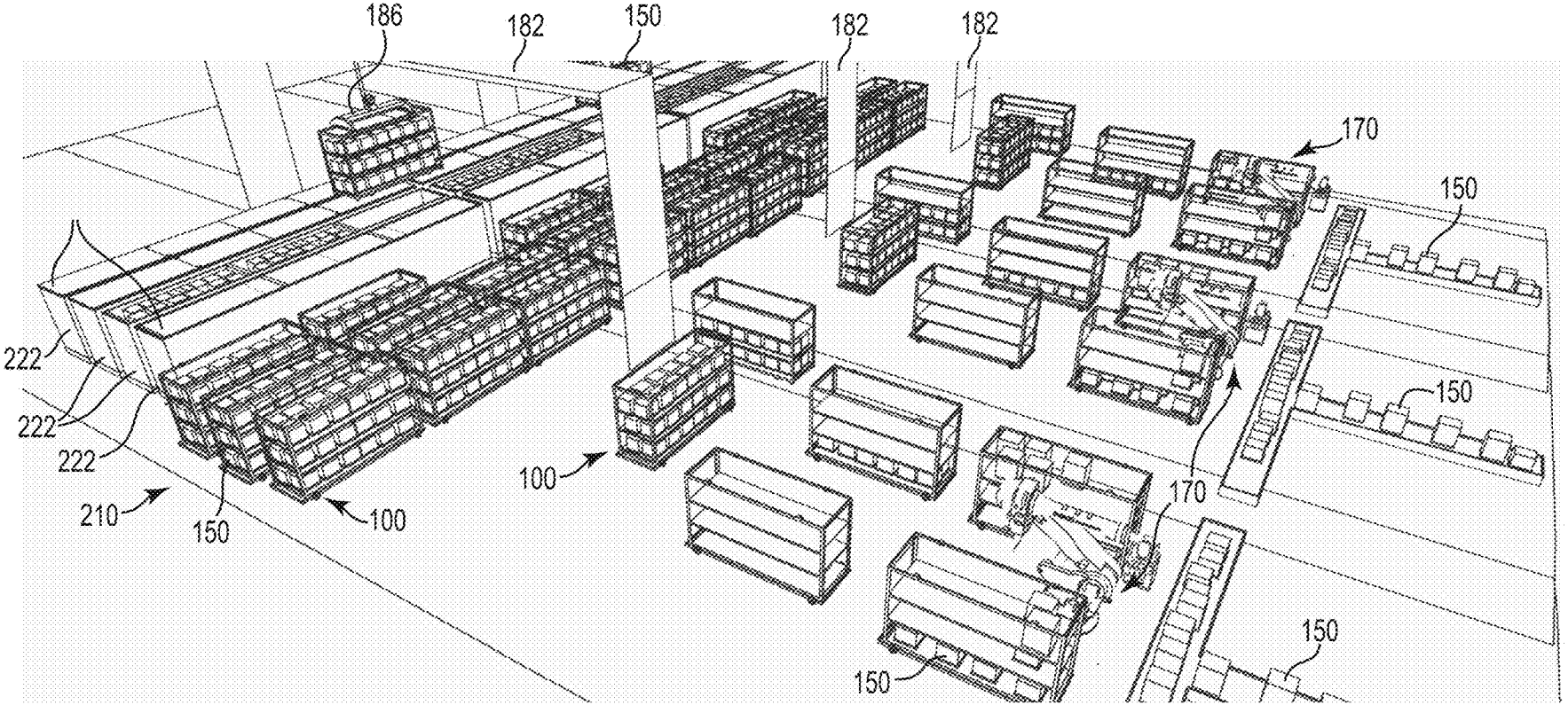
FIGS. 7A and 7B show an example of a method of pre-loading cargo onto removable carriers, and loading the pre-loaded carriers into top-loading cargo vessels, as described.
Figure 7B:
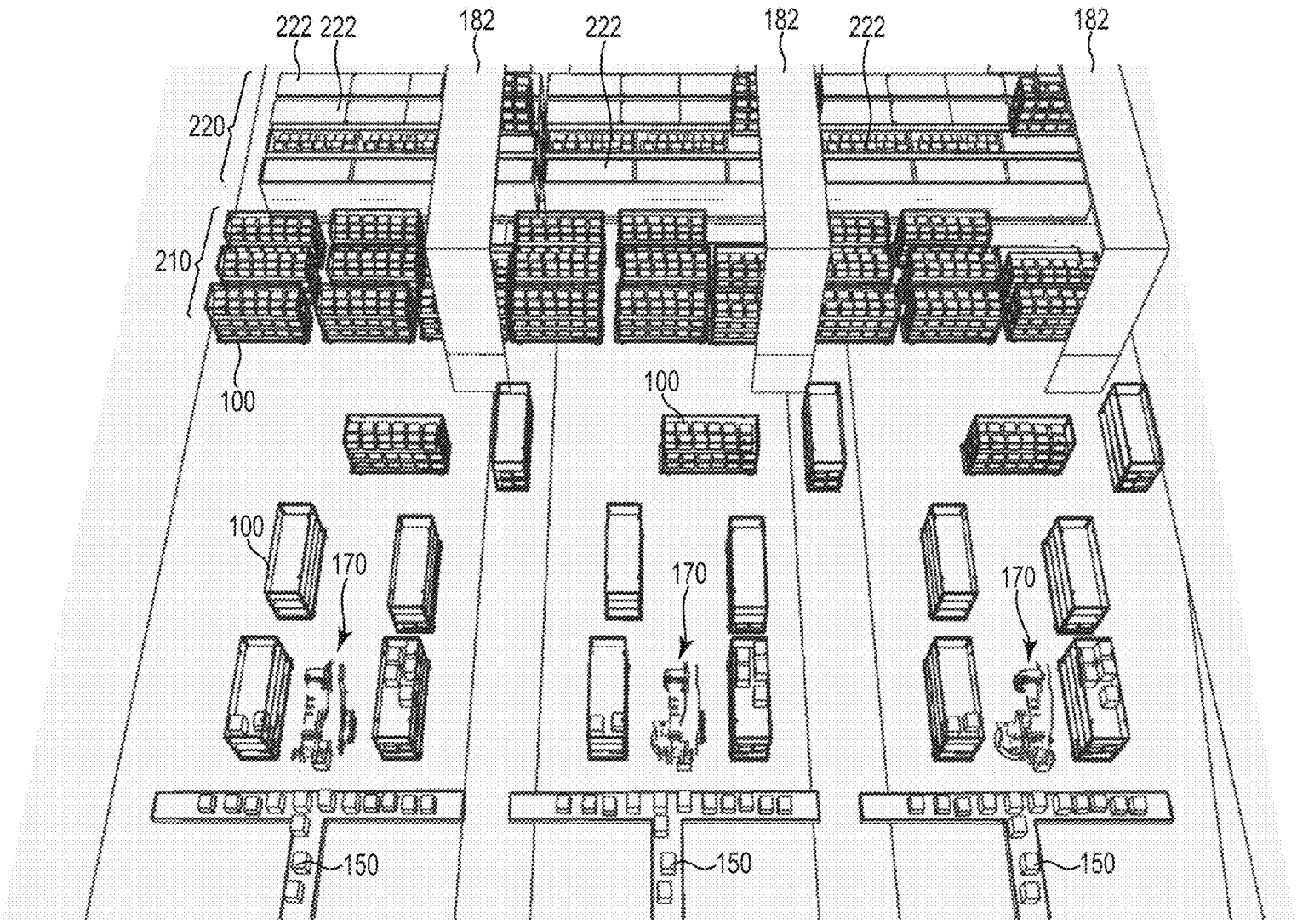
Figure 7C:
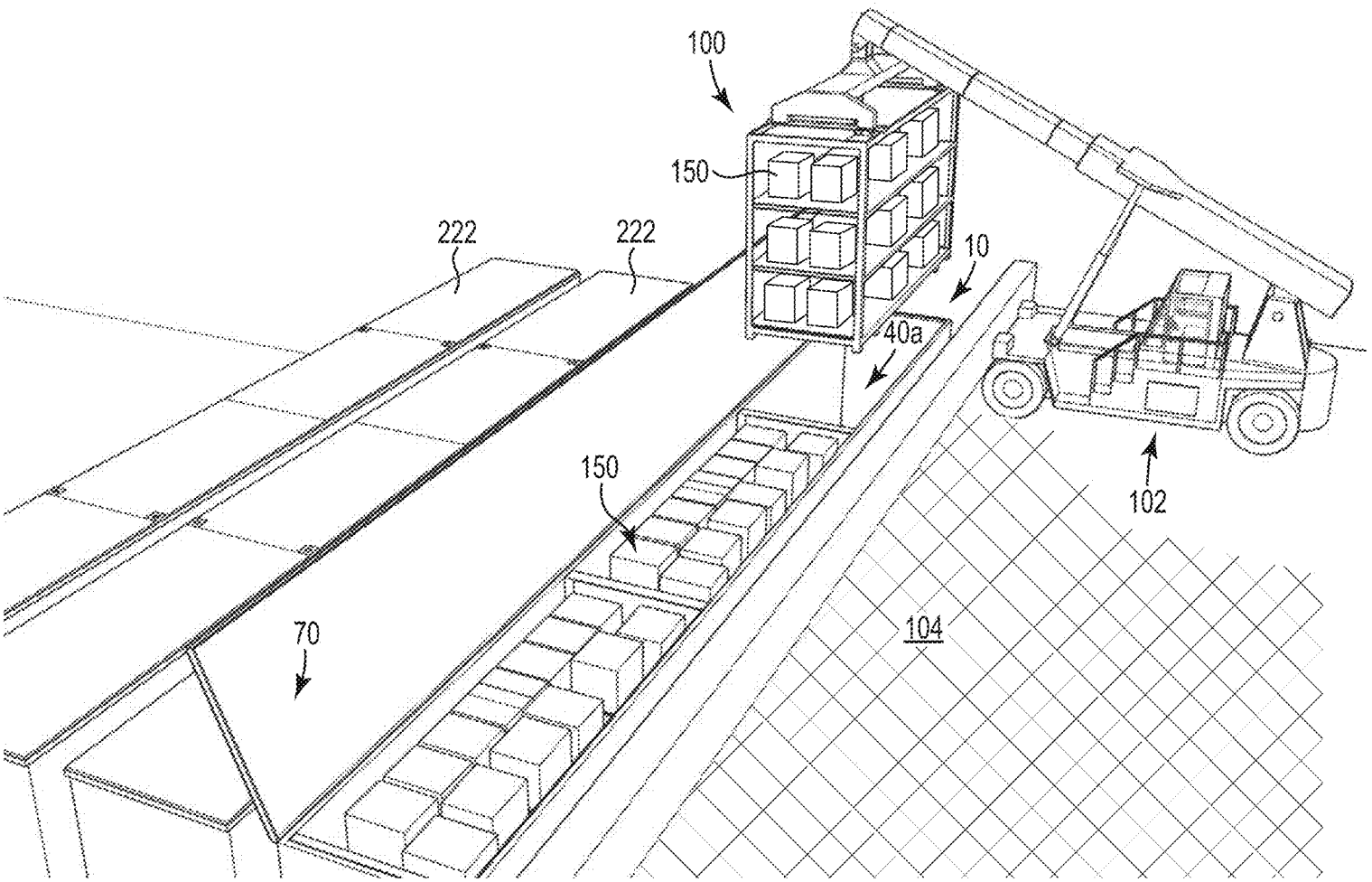
FIG. 7C shows an alternate method of loading pre-loaded removable cargo carriers into a cargo transport vessel.

In an alternate loading system, shown at FIG. 7C, stacker 102 is located at elevated platform 104, which is raised vertically above the railroad that supports trains 222. The stacker 102 loads and unloads cargo carriers 100 from cars 10 of train 22.

The invention claimed is:

1. A top-loading railcar comprising:
a deck,
wheels supporting the deck,
an interior defined by walls comprising: a front wall extending vertically from the deck, a back wall extending vertically from the deck, one or more vertical separators extending vertically from the deck, and two sidewalls extending vertically from each of the two deck sides,
a first interior segment and a second interior segment within the interior each formed in part by the one or more vertical separators,
a first top opening at a top of the first interior segment,
a second top opening at a top of the second interior segment,
a first roof that is capable of an opened position that exposes the first top opening and allows access to the first interior segment, and a closed position that covers the first top opening,
a second roof that is capable of an opened position that exposes the second top opening and allows access to the second interior segment, and a closed position that covers the second top opening,
a first removable cargo carrier that comprises vertical frame supports, a bottom shelf, and a horizontal support supported by the vertical frame supports, and that is adapted to be placed into and removed from the first interior segment through the first top opening,
a second removable cargo carrier that comprises vertical frame supports, a bottom shelf, and a horizontal support supported by the vertical frame supports, and that is adapted to be placed into and removed from the second interior segment through the second top opening.

2. A railcar of claim 1, having:
an interior length in a range from 50 to 100 feet, and
an interior width in a range from 5 to 11 feet.

3. A railcar of claim 1, the first removable cargo carrier comprising multiple horizontal supports, a first length side, a second length side, a front side, and a rear side, with at least two of the sides being open laterally to allow loading or un-loading cargo onto or from the cargo carrier through the at least two open sides, when the first removable cargo carrier is removed from the first interior segment.

4. A railcar of claim 1, wherein:
the first removable cargo carrier comprising multiple horizontal supports, a first length side, a second length side, a front side, and a rear side, and
a horizontal support adapted to slide through an opening between vertical supports at the front side or the rear side in a direction along the length sides of the carrier, to be loaded onto or removed from the frame.

5. A railcar of claim 4, wherein the railcar interior has a width that is not more than 3 feet greater than the width of the first removable cargo carrier.

6. A railcar of claim 5, the first removable cargo carrier having:
a length in a range from 15 to 29 feet, and
a width in a range from 8 to 10 feet.

7. A method of placing cargo into a top-loading railcar, the railcar comprising:
a deck,
wheels supporting the deck,
walls extending vertically from the deck to define a railcar interior that comprises a first interior segment and a second interior segment,
a first top opening at a top of the first interior segment defined by a top of the walls,
a second top opening at a top of the second interior segment defined by a top of the walls,
the method comprising:
placing a first removable cargo carrier through the first top opening and into the first interior segment, the first removable cargo carrier comprising:
vertical frame supports, a bottom shelf, and a horizontal support supported by the vertical frame supports, and
cargo supported on the horizontal support;
placing a second removable cargo carrier through the second top opening and into the second interior segment, the second removable cargo carrier comprising:
vertical frame supports, a bottom shelf, and a horizontal support supported by the vertical frame supports, and
cargo supported on the horizontal support;
placing a first roof over the first top opening; and
placing a second roof over the second top opening.

8. A method of claim 7, wherein:
the railcar is loaded with cargo to at least 70 percent of a nominal capacity by weight, and
the center of gravity of the railcar is no higher than 104 inches, above a top of a rail that supports the railcar.

9. A method of placing cargo into two or more top-loading railcars, each top-loading railcar comprising:

a deck, wheels supporting the deck, walls extending vertically from the deck to define a railcar interior that comprises a first interior segment and a second interior segment, a first top opening at a top of the first interior segment defined by a top of the walls, and a second top opening at a top of the second interior segment defined by a top of the walls, the method comprising:

with a first train on a rail line, the first train comprising one or more top-loading railcars, with a second train on a rail line parallel to the first train, the second train comprising one or more top-loading railcars, loading a first removable cargo carrier through the first top opening of a top-loading railcar of the first train, the first removable cargo carrier comprising vertical frame supports a bottom shelf, and a horizontal support supported by the vertical frame supports, with the cargo supported on the horizontal support, loading a second removable cargo carrier through the second top opening of a top-loading railcar of the first train, the second removable cargo carrier comprising vertical frame supports, a bottom shelf, a horizontal support supported by the vertical frame supports, with the cargo supported on the horizontal support, loading a third removable cargo carrier through the first top opening of a top-loading railcar of the second train, the third removable cargo carrier comprising vertical frame supports, a bottom shelf, and a horizontal support supported by the vertical frame supports, with the cargo supported on the horizontal support, and loading a fourth removable cargo carrier through the second top opening of a top-loading railcar of the second train, the fourth removable cargo carrier comprising vertical frame supports, a bottom shelf, and a horizontal support supported by the vertical frame supports, with the cargo supported on the horizontal support.

10. A method of claim 7, wherein:

the first removable cargo carrier comprises multiple horizontal supports, a first length side, a second length side, a front side, and a rear side, and a horizontal support is adapted to slide through an opening between vertical supports at the front side or the rear side in a direction along the length sides of the removable cargo carrier, the method comprising:

removing the horizontal support from the first removable cargo carrier by sliding the horizontal support between the vertical supports at the front side or at the rear side, with the horizontal support located away from the first removable cargo carrier, placing cargo onto the horizontal support, and placing the horizontal support and the cargo onto the first removable cargo carrier by sliding the horizontal support between the vertical supports at the front side or at the rear side.

11. A railcar of claim 1, wherein:

the first removable cargo carrier comprises multiple horizontal supports, a first length side, a second length side, a front side, and a rear side, with at least two of the sides being open laterally to allow loading or unloading cargo onto or from the cargo carrier through the at least two open sides, when the removable cargo carrier is removed from the interior, and a horizontal support is adapted to slide through an opening between vertical supports at the front side or the rear side in a direction along the length sides of the removable cargo carrier, to be loaded onto or removed from the removable cargo carrier.

12. The method of claim 7, wherein the first roof is attached to the first removable cargo carrier and covers at least a portion of the first top opening.

13. The method of claim 9, comprising:

placing the first removable cargo carrier through the first top opening of the top-loading railcar of the first train and into the first interior segment, with the roof covering the first top opening, and placing the third removable cargo carrier through the first top opening of the top-loading railcar of the second train and into the first interior segment, with the roof covering the first top opening.

14. The method of claim 9, wherein:

the first removable cargo carrier comprises multiple horizontal supports, a first length side, a second length side, a front side, and a rear side, and a horizontal support of the first removable cargo carrier is adapted to slide through an opening between vertical supports at the front side or the rear side in a direction along the length sides of the first removable cargo carrier to be removed from the first removable cargo carrier, the method comprising:

removing the horizontal support of the first removable cargo carrier by sliding the horizontal support from the frame between the vertical supports at the front side or at the rear side, with the horizontal support located away from the first removable cargo carrier, placing cargo onto the horizontal support, and placing the horizontal support and the cargo onto the first removable cargo carrier by sliding the horizontal support between the vertical supports at the front side or at the rear side.

15. The method of claim 13, wherein:

the first removable cargo carrier comprises multiple horizontal supports, a first length side, a second length side, a front side, and a rear side, and a horizontal support of the first removable cargo carrier is adapted to slide through an opening between vertical supports at the front side or the rear side in a direction along the length sides of the first removable cargo carrier to be removed from the first removable cargo carrier, the method comprising:

removing the horizontal support of the first removable cargo carrier by sliding the horizontal support from the frame between the vertical supports at the front side or at the rear side, with the horizontal support located away from the first removable cargo carrier, placing cargo onto the horizontal support, and placing the horizontal support and the cargo onto the first removable cargo carrier by sliding the horizontal support between the vertical supports at the front side or at the rear side.

16. The railcar of claim 1, wherein the first roof is incorporated into the structure of the first removable cargo carrier.

17. The railcar of claim 1, wherein the first roof is attached to the removable cargo carrier at an upper portion of the first removable cargo carrier.

18. The railcar of claim 1, wherein the first roof covers a top of the first carrier.

19. The railcar of claim 1, wherein the first roof exposes the first top opening by lifting and is not attached to a railcar wall by a hinge.

20. The method of claim 7, wherein the first roof exposes the first opening by lifting and is not attached to a railcar wall by a hinge.

* * * * *